US005595162A

United States Patent [19]

Iwai

[11] Patent Number: 5,595,162

[45] Date of Patent: Jan. 21, 1997

[54] START UP FUEL CONTROL DEVICE FOR AN ENGINE

[75] Inventor: Akira Iwai, Toyota, Japan

[73] Assignee: Toyota Jidosha Kabushiki Kaisha, Aichi, Japan

[21] Appl. No.: 579,491

[22] Filed: Dec. 27, 1995

[30] Foreign Application Priority Data

Dec. 28, 1994 [JP] Japan ..... 6-327746

[51] Int. Cl.[6] ..... F02M 51/00

[52] U.S. Cl. ..... 123/491

[58] Field of Search ..... 123/491, 436, 123/179.17, 492, 493, 480, 179.16, 575, 1 A, 520; 364/431.1, 431.04, 431.05, 431.07, 431.08

[56] References Cited

U.S. PATENT DOCUMENTS

| | | | |
|---|---|---|---|
| 5,224,456 | 7/1993 | Hosoda et al. | 123/520 |
| 5,320,079 | 6/1994 | Kuwabara | 123/491 |
| 5,365,917 | 11/1994 | Adams et al. | 123/491 |
| 5,469,827 | 11/1995 | Tomisawa | 123/491 |
| 5,474,047 | 12/1995 | Cochard et al. | 123/491 |
| 5,497,752 | 3/1996 | Sagisaka et al. | 123/491 |
| 5,507,265 | 4/1996 | Ichikawa et al. | 123/491 |

FOREIGN PATENT DOCUMENTS

| | | | |
|---|---|---|---|
| 59-147832 | 8/1984 | Japan | 123/491 |
| 60-73028 | 4/1985 | Japan | 123/491 |
| 3-185239 | 8/1991 | Japan | 123/491 |
| 3-249345 | 11/1991 | Japan | 123/491 |
| 3-271539 | 12/1991 | Japan | 123/491 |

*Primary Examiner*—Raymond A. Nelli
*Attorney, Agent, or Firm*—Kenyon & Kenyon

[57] ABSTRACT

The start up fuel control device according to the present invention controls the fuel supply amount to an engine during the cranking operation. After the cranking operation starts, the device measures the time lapsed since the cranking operation started. Further, the measured time is stored in a backup RAM which can preserve the content of its memory even if a main switch of the engine is turned off. Since the time lapsed from the beginning of the cranking operation (cranking time) can be considered as a parameter representing the amount of unburnt fuel remaining in the cylinder, the device performs the following operation based on the cranking time to prevent the air-fuel ratio of the air-fuel mixture in the cylinders becomes too low (rich) for firing to occur. When the cranking time exceeds a predetermined period, the device starts a scavenging operation in which the fuel supplied to the engine is reduced in order to expel the fuel remaining in the cylinders by the cranking operation. After performing the scavenging operation for a predetermined period, the device increases the fuel supplied to the engine until it reverts to the value before the scavenging operation started.

15 Claims, 17 Drawing Sheets

START UP FUEL CONTROL DEVICE FOR AN ENGINE

BACKGROUND OF THE INVENTION

1. Field of the Invention

This invention relates to a start up fuel control device for an internal combustion engine which is capable of adjusting the amount of fuel supplied to the engine in such a manner that the engine starts in a short time.

2. Description of the Related Art

In some cases, such as a cold start of an engine in a low ambient temperature, a long starting operation (cranking) of the engine is required before the engine starts (i.e. a stable combustion occurs in each cylinder of the engine). In such a case, since a portion of the fuel supplied to the cylinder accumulates therein without being expelled during exhaust strokes, an air-fuel ratio of the air-fuel mixture in the cylinders of the engine gradually becomes lower (i.e., becomes rich) during the starting operation. Therefore, if the starting operation continues for a long time, the air-fuel ratio of the air-fuel mixture in the cylinder may become excessively rich. This makes the engine impossible to start. To prevent this problem, caused by residual fuel in the cylinders, a start up fuel control device is used for performing a scavenging operation of the engine when the cranking of the engine continues, without firing, for more than a predetermined time.

This kind of the start up fuel control device is disclosed in, for example, Japanese Unexamined Patent Publication (Kokai) No. 3-185239. The device in this publication is equipped with means for detecting the occurrence of firing in the respective cylinders of the engine. When firing is not detected after the engine rotates a predetermined stroke cycles (for example, 10 stroke cycles), the device initiates a scavenging operation in which the amount of the fuel supplied to the engine is gradually reduced to expel the residual fuel in the cylinders by cranking. Further, when the initial firing is detected in a cylinder, the device increases the amount of the fuel supplied to the cylinder in which the initial firing is detected until the fuel supply amount reaches the amount before the scavenging operation started. Therefore, the air-fuel ratio of the air-fuel mixture in the non-firing cylinders gradually increases (become less rich) and becomes an air-fuel ratio suitable for firing. Further, if initial firing is detected, the amount of the fuel supplied to the cylinders in which the initial firing is detected is increased to a normal value to thereby obtain stable combustion in these cylinders.

However, sometimes problems arise in the device of the above publication since the device counts the number of the stroke cycles of the engine from the beginning of each starting operation. For example, when the engine fails to start, usually the operator of the engine turns off a main switch of the engine to wait the recovery of the battery voltage and tries to restart the engine. In this case, the device in the above publication clears the number of the stroke cycle in the previous starting operation when the main switch is turned off, and starts counting the cycles from the beginning of the next starting operation. Therefore, if the starting operation is not successful and short starting operations are repeated with the main switch being turned on and off, the device clears the stored number of the cycles every time when the main switch is turned off. Thus, the scavenging operation is not performed in the succeeding starting operation since the number of the cycles in each starting operation does not reach the predetermined value. Therefore, residual fuel in the cylinders increases by repeating the staring operation and the possibility of starting the engine becomes more and more remote.

Further, in the device of the above publication, the scavenging operation of the cylinders continues until initial firing is detected in the cylinders. The air-fuel ratio of the air-fuel mixture in the non-firing cylinders gradually increases (i.e., becomes lean) and passes through the range suitable for firing during the scavenging operation. However, if firing does not occur when the air-fuel ratio passes through the suitable range, the air-fuel ratio in the cylinders becomes excessively lean. Therefore, in the device of the above publication, if firing does not occur when the air-fuel ratio passes through the suitable range, starting the engine becomes impossible due to the excessively lean air-fuel ratio in the cylinders.

SUMMARY OF THE INVENTION

In view of the problems set forth above, the object of the present invention is to provide a starting fuel control device, for an engine, which is capable of adjusting the amount of the fuel supplied to the engine in accordance with the amount of the residual fuel in the cylinder during the starting operation even though the main switch is turned off between successive starting operations.

According to the present invention, there is provided a start up fuel control device, for an internal combustion engine having cylinders, which comprises start up determining means for determining whether the engine has started, residual fuel amount calculating means for calculating a residual fuel amount parameter relating to the amount of fuel remaining in the cylinders of the engine during a start up operation of the engine, memory means for memorizing the latest value of the residual fuel amount parameter from the beginning of the start up operation of the engine until the start up determining means determines that the engine has started, regardless of whether a main switch of the engine is turned on or turned off, scavenging means for initiating a scavenging operation of the engine in which a fuel supply amount to the engine is reduced when the value of the residual fuel amount parameter memorized in the memory means becomes larger than a predetermined first value, a scavenged fuel amount calculating means for calculating a scavenged fuel amount parameter relating to the amount of fuel expelled from the cylinders since the scavenging operation of the engine started, and restoring means for increasing the fuel supply amount to the engine when the value of the scavenged fuel amount parameter becomes larger than a predetermined second value until the fuel supply amount reaches a fuel supply amount before the scavenging operation started.

According to the present invention, the memory means memorizes the value of the residual fuel amount parameter relating to the amount of fuel remaining in the cylinder regardless of whether the main switch of the engine is turned on or off. The scavenging means initiates the scavenging operation when the value of the residual fuel amount parameter becomes more than a predetermined first value. Therefore, even if short starting operations are repeated at intervals in which the main switch is turned off, the scavenging operation is performed exactly in accordance with the amount of the residual fuel in the cylinders. Further, the restoring means increases the fuel supply amount to the cylinder when the amount of the fuel expelled from the cylinders during the scavenging operation becomes more than a predetermined second value.

Therefore, even if the engine fails to start during the scavenging operation, the air-fuel ratio in the cylinders becomes lower again (becomes rich) after the scavenging operation is continued for a certain period. Thus, the air-fuel ratio in the cylinders is prevented from becoming excessively lean.

BRIEF DESCRIPTION OF THE DRAWINGS

The present invention will be better understood from the description, as set forth hereinafter, with reference to the accompanying drawings in which.

DESCRIPTION OF PREFERRED EMBODIMENTS

Figure 1:
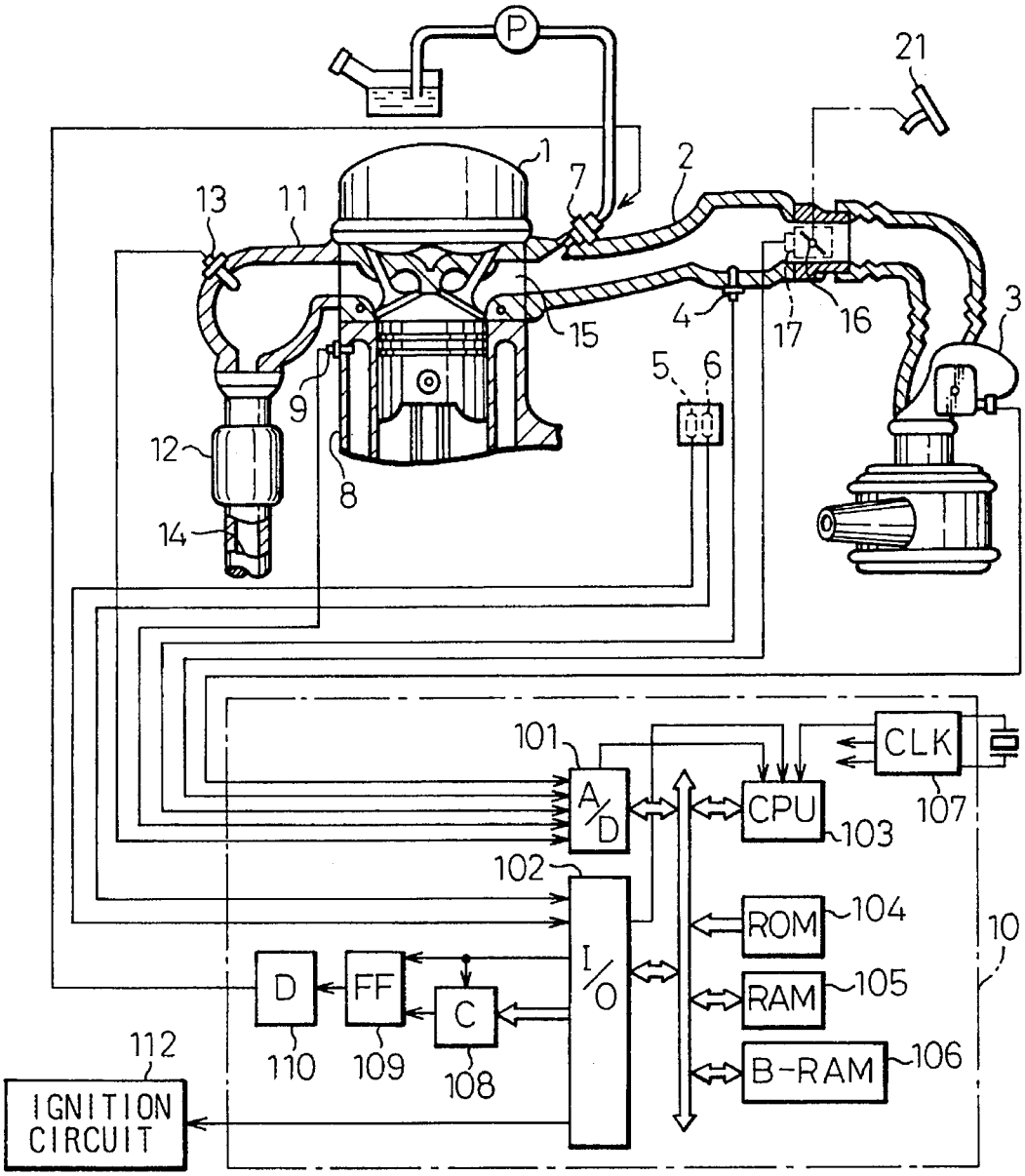
FIG. 1 is a drawing showing an embodiment of the start up fuel control device according to the present invention when applied to an automobile engine.

FIG. 1 schematically illustrates an embodiment of the present invention in which a start up fuel control device is applied to a multiple-cylinder type automobile engine. In FIG. 1, reference numeral 1 designates an internal combustion engine, 2 designates a inlet air passage connected to inlet ports 15 of the respective cylinders of the engine 1. In the inlet air passage 2 is a throttle valve 16 which opens to a degree of opening in accordance with the amount of depression of an accelerator pedal 21 by the driver of the automobile. 17 in FIG. 1 designates a throttle opening sensor disposed near the throttle valve 16 which generates a voltage signal corresponding to the degree of opening of the throttle valve 16. Numeral 7 designates fuel injection valves each disposed in the inlet manifold near the respective inlet ports 15 for injecting pressurized fuel into the inlet ports 15.

In FIG. 1, 11 represents an exhaust manifold which connects the exhaust ports of the respective cylinders to a common exhaust passage 14. In the exhaust manifold 11, an $O_2$ sensor 13 is disposed. The $O_2$ sensor 13 generates a voltage signal corresponding to the concentration of the $O_2$ component in the exhaust gas. 14 in FIG. 1 is a three-way reducing and oxidizing catalytic converter disposed on the exhaust passage 14. The catalytic converter 12 is capable of removing the HC, CO and $NO_x$ components in the exhaust gas when the air-fuel ratio of the exhaust gas is near the stoichiometric air-fuel ratio.

Numeral 3 in FIG. 1 shows an airflow meter disposed on the inlet air passage 2. The airflow meter 3 is, for example, a movable vane type which generates a voltage signal corresponding to the amount of airflow into the engine 1. Further, an inlet air temperature sensor 4 is disposed on the inlet air passage 2, and a cooling water temperature sensor 9 is disposed on a cooling water jacket 8 of the engine 1. The inlet air temperature sensor 4 and the cooling water temperature sensor 9 generate voltage signals corresponding to the inlet air temperature and the cooling water temperature, respectively.

The analogue voltage signals from the airflow meter 3, the inlet air temperature sensor 4, the $O_2$ sensor 13, the throttle opening sensor 17 and cooling water temperature sensor 9 are supplied to a multiplexer-incorporated A/D converter 101 of the control circuit 10.

Numerals 5 and 6 in FIG. 1 designate crank angle sensors which are disposed near the crankshaft (not shown) and generate pulse signals at a predetermined rotation angle of the crankshaft. In this embodiment, the crank angle sensor 5 generates a reference pulse signal at every 720° rotation of the crankshaft, and the crank angle sensor 6 generates a crank angle pulse signal at every 30° rotation of the crankshaft. The pulse signals from the sensors 5 and 6 are supplied to an input/output interface 102 of the control circuit 10. Further, the crank angle pulse signal from the sensor 6 is fed to an interrupt terminal of the CPU 103 of the control circuit 10.

The control circuit 10, which may consist of a microcomputer, comprises a central processing unit (CPU) 103, a read-only-memory (ROM) 104 for storing a main routine and interrupt routines such as a fuel injection control routine and an ignition timing control routine, and constants used for routines, etc., a random-access-memory (RAM) 105 for storing temporary data, a backup RAM 106, and a clock generator 107 for generating various clock signals. The backup RAM 106 is directly connected to a battery (not shown), and capable of preserving its contents even when the main switch (not shown) is turned off.

A down counter 108, a flip-flop 109 and a drive circuit 110 are provided in the control circuit 10 for controlling the fuel injection valve 7. When a fuel injection amount is calculated by the routine explained later, the injection amount is preset in the down counter 108, and simultaneously, the flip-flop 109 is set, and thereby the drive circuit 110 initiates the activation of the fuel injection valve 7. On the other hand, the down counter 108 counts up the clock signals from the clock generator 107, and finally, a logic 1 signal is generated from the terminal of the down counter 108, to reset the flip-flop 109, so that the drive circuit 110 stops the activation of the fuel injection valve 7, whereby an amount of fuel corresponding to the calculated fuel amount is supplied to the cylinders.

The input/output interface 102 of control circuit 10 is connected to an ignition circuit 112 for controlling the ignition timing of engine 1. The control circuit 10 outputs an ignition signal to the ignition circuit every time the crankshaft rotates a predetermined angle after the reference pulse signal is fed through the input/output interface 102 to thereby cause a spark at the ignition plug (not shown) of the respective cylinder. Optimum values of the ignition timing are stored in the ROM 104 of the control circuit 10 as a function of the operating conditions of the engine such as engine load (inlet air amount per one revolution of the engine) and engine speed, and the actual ignition timing is determined in accordance with the operating conditions of the engine.

An interrupt occurs at CPU 103 when the A/D converter 101 completes an A/D conversion; when the clock generator 107 generates a special clock signal; when the A/D converter 101 generates a special interrupt signal; and when the crank angle sensor 6 generates a reference pulse signal. The analogue voltage signals from the airflow meter 3, the inlet air temperature sensor 4, the throttle opening sensor 17 and the cooling water temperature sensor 9 are A/D converted by an A/D conversion routine(s) executed at predetermined intervals (or, alternatively, at predetermined crank angles) and stored in the RAM 105 as an inlet air amount data Q, an inlet air temperature data THA, a throttle opening data TH and a cooling water temperature data THW. The engine speed is calculated from the intervals of the pulse signals from the crank angle sensor 5 by an interrupt routine executed at every 30° rotation of the crankshaft and stored in the RAM 105 as an engine speed data NE. Namely, the RAM 105 always stores the latest values of the data Q, THA, TH, THW and NE.

The start-up fuel control of the engine 1 in FIG. 1 is performed by the control circuit 10 in the manner explained below.

Figure 2:
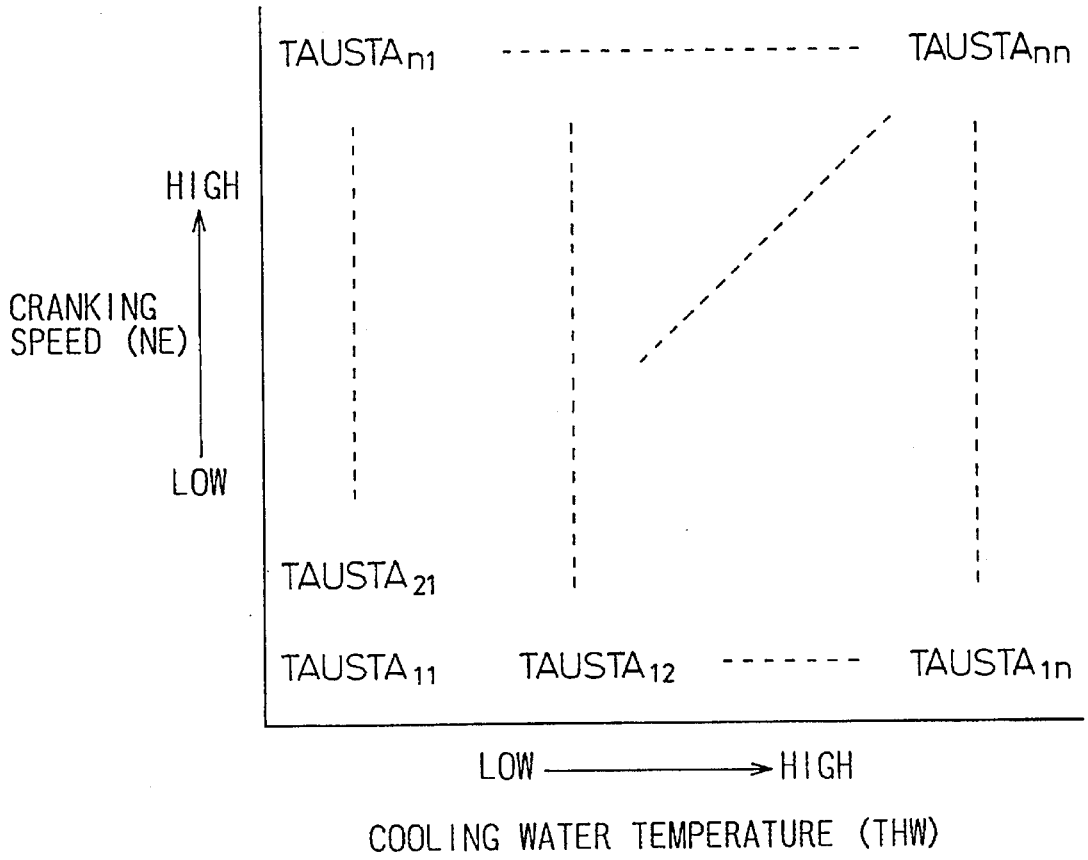
FIG. 2 shows a form of a numerical table used in the routine shown in FIG. 3.

In this embodiment, the fuel injection amount TAUSTA during the starting operation (cranking) of the engine 1 is determined in accordance with the engine speed NE in the cranking operation (i.e., cranking speed) and the cooling water temperature THW. For example, the value of TAUSTA is set larger as the cooling water temperature THW becomes lower and the engine speed NE becomes lower, to thereby facilitate the engine start. In this embodiment, suitable values for TAUSTA are determined beforehand in accordance with various sets of values of THW and NE, and stored in ROM 104 in a form of a numerical table based on THW and NE as shown in FIG. 2. The starting fuel amount TAUSTA is determined in such a manner that the air-fuel ratio of the air-fuel mixture in the cylinders becomes rich compared to the stoichiometric air-fuel ratio to facilitate the engine start. Therefore, if firing does not occur in the cylinders, and if the fuel supply of amount TAUSTA is maintained during the cranking operation, the air-fuel ratio in the cylinders becomes gradually richer. This may cause the air-fuel ratio in the cylinders to become excessively rich, and make it impossible to start the engine.

In this embodiment, this problem is solved by the start up fuel control explained below. Namely, in this embodiment, the CPU 10 measures the time lapsed since the starting operation (cranking) started and stores the measured time in the backup RAM 106 provided separately from the RAM 105. The starting and the stopping of the scavenging operation is controlled by the measured time stored in the backup RAM 106. Since the cranking speed of the engine 1 is nearly constant, the time lapsed since the beginning of the cranking (i.e., cranking time) is proportional to the number of occurrences of fuel injection. Therefore, the cranking time can be used as a parameter for representing a total amount of the fuel supplied to the engine during the cranking operation. Since the amount of the residual fuel in the cylinders increases in accordance with the total amount of the fuel, it can be considered that the air-fuel ratio of the air-fuel mixture in the cylinders becomes excessively rich if the engine does not start after a certain time lapsed since the cranking starts. Therefore, in this embodiment, the CPU 10 starts the scavenging operation by reducing the fuel supply amount to the engine if the engine does not start after a predetermined time after the cranking started.

Further, the cranking time also represents the total amount of inlet air which has passed through the cylinders during the cranking operation. Therefore, the cranking time after the scavenging operation started can be considered to be proportional to the total amount of air used for scavenging the cylinders. The amount of the fuel expelled from the cylinder during the scavenging operation increases in accordance with the amount of air passing through the cylinders during the cranking operation. Consequently, the cranking time after the scavenging operation started can be used as a parameter representing the total amount of the fuel expelled from the cylinder during the scavenging operation. Namely, if the cranking time after the scavenging operation started exceeds a certain period, it can be considered that a substantial portion of the residual fuel is expelled from the cylinders by the scavenging operation. Therefore, in this embodiment, the CPU 10 terminates the scavenging operation by increasing the fuel supply amount to the engine to the calculated starting fuel amount when the cranking time becomes longer than a predetermined time to thereby prevent the air-fuel ratio of the air-fuel mixture in the cylinders from becoming excessively lean. By this restoring operation, the air-fuel ratio of the air-fuel mixture in the cylinders becomes gradually rich and again passes through the range suitable for firing.

Further, the value of the cranking time is stored in the backup RAM 106 which can preserve the content of the memory even when the main switch of the engine is turned off. Therefore, even if short cranking operations are repeated with intervals in which the main switch is turned off, the total cranking time for the respective cranking operations is preserved in the backup RAM 106, and the cranking time stored in the backup RAM 106 accurately represents the amount of the residual fuel in the cylinders. The value of the cranking time stored in the backup RAM 106 is cleared when the engine starts.

Figure 3:
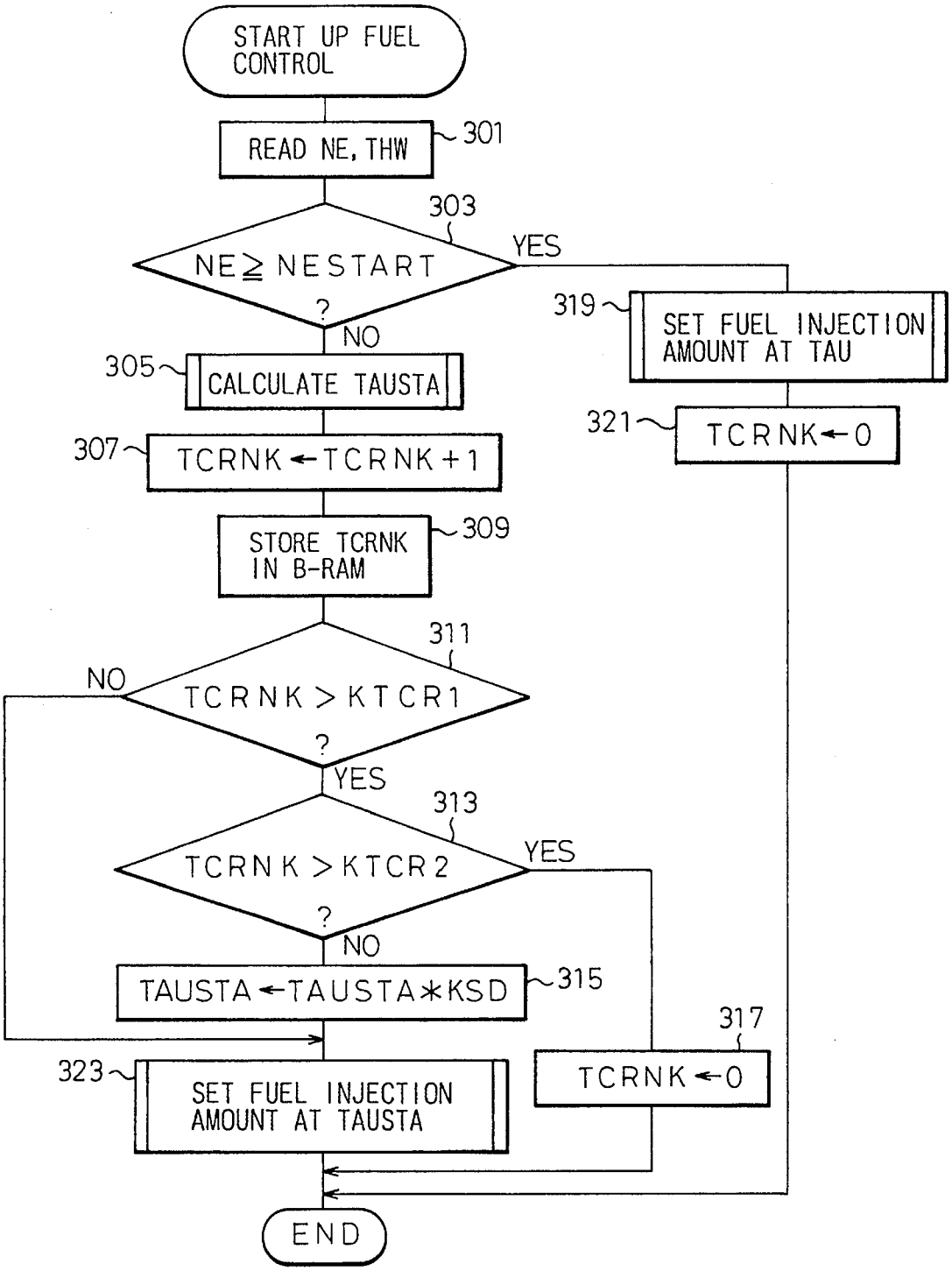
FIG. 3 is a flowchart showing an example of a start up fuel control routine.

FIG. 3 shows a flowchart illustrating the start up fuel control of the present embodiment. This routine is executed as a part of a main routine executed by the CPU 10. The main routine is executed, for example, about every 10 ms when the engine speed is low (such as during the starting operation).

When the routine starts, in FIG. 3, at step 301, the engine speed data NE and the cooling water temperature data THW are read from a predetermined storage area of the RAM 104. Then, at step 303, it is determined whether the engine has started by comparing the engine speed with a predetermined speed NESTART. NESTART is an engine speed which indicates that the engine has started and set at much higher than the cranking speed (for example, NESTART is set at about 400 rpm in this embodiment).

If the engine has not started at step 303, i.e., if the starting operation is being performed, the routine proceeds to step 305 which determines the start up fuel amount TAUSTA from the numerical table in FIG. 2 using the engine speed NE and the cooling water temperature THW read at step 301.

Further, a cranking time counter TCRNK is increased by 1 at step 307, and the value of the TCRNK after it is increased is stored in the backup RAM 106 at step 309. As explained later, since the value of the counter TCRNK was cleared at step 321 when the engine last started, the value of the counter TCRNK stored in the backup RAM 106 represents the total cranking time since the first starting operation was started.

At step 311, it is determined whether the value of TCRNK exceeds a predetermined value KTCR1. If TCRNK≦KTCR1 at step 311, namely, if a predetermined time is not lapsed since the starting operation started, then step 323 is performed to set the fuel injection amount TAUSTA in the down counter 108 of the control circuit 10, and the routine terminates this time. By these steps, the amount TAUSTA of the fuel calculated at step 305, is set in the down counter 108, and the fuel of amount TAUSTA, i.e., normal start up fuel supply amount is supplied to the engine 1 until the predetermined time lapses since the cranking started. The value KTCR1 corresponds to the length of the cranking operation which causes the air-fuel ratio of the air-fuel mixture in the cylinders to reach the lower limit for firing and is determined by experiment using an actual engine (for example, KTCR1 is set at the value corresponding to, for example, about 15 seconds in this embodiment).

If TCRNK>KTCR1 at step 311, the routine proceeds to step 313 which determines whether the value of the counter TCRNK exceeds a predetermined second value KTCR2. If TCRNK≦KTCR2 at step 313, since this means that the scavenging operation of the engine is now being performed, the routine performs steps 315 and 323 which multiply the value of TAUSTA calculated at step 305 by a predetermined constant KSD, and set the value of TAUSTA after it is multiplied in the down counter 108. Then the routine terminates. The value KTCR2 corresponds to the time at which the air-fuel ratio of the air-fuel mixture in the cylinders reaches the higher limit for firing (lean limit) due to the scavenging operation, and it is preferable to determine the value of KTCR2 by experiment using an actual engine. In this embodiment, KTCR2 is set at the value corresponding to, for example, about 20 seconds.

KSD is a constant less than 1.0 (for example, KSD is set at a constant value between 0 and 0.2 in this embodiment). By these steps, the fuel supply amount to the engine is reduced compared to the normal start up fuel amount calculated at step 305, i.e., the scavenging operation of the engine is performed.

On the other hand, if TCRNK>KTCR2 at step 315, i.e., if a predetermined time has lapsed since the value of TCRNK reached KTCR2, the value of the counter TCRNK is cleared at step 317, and the value of the counter TCRNK is increased from 0 in the following executions of the routine. Therefore, once the scavenging operation completed, the normal start up fuel supply amount calculated at step 305 is supplied to the engine by steps 311 and 323 until the value of the counter TCRNK again reaches KTCR1.

Further, if NE≧NESTART at step 303, i.e., if the engine has started at step 303, a fuel supply amount in the normal operation TAU is set in the down counter 108. The fuel supply amount in the normal operation TAU is calculated by a routine (not shown) performed by the control circuit 10 at predetermined crank angles (for example at every 360° rotation of the crankshaft) in accordance with amount of inlet air per one revolution of the engine (Q/NE). Further, when the engine has started at step 303, the value of the counter TCRNK is cleared at step 321. Therefore, when the next starting operation is initiated, i.e., when the starting operation is initiated after the engine is stopped normally, the value of the counter TCRNK is always set at 0.

As explained above, when the engine starting operation is initiated, a cranking operation with normal fuel supply amount is performed for a predetermined time. Then, when the cranking operation with normal fuel supply amount continues more than a predetermined time, the scavenging operation, in which the fuel supply amount is reduced, is performed for a predetermined period. Further, when the scavenging operation is performed for a predetermined period, the fuel supply amount to the engine is increased to the normal fuel supply amount. Also, if firing occurs in the cylinders during the cranking operation and the engine speed increases, the start up fuel control in steps 305 through 323 is terminated, and the fuel supply amount is controlled in a normal operation mode at steps 319 and 321.

Further, if the cranking operation is aborted by turning off the main switch during the starting operation of the engine, the cranking time stored in the backup RAM 106 is preserved. Therefore, even if the cranking operation is resumed after an ignition off period, the fuel supply amount to the engine is determined in accordance with the amount of the residual fuel in the cylinders, thus the air-fuel ratio in the cylinders does not become excessively rich.

Therefore, a startability of the engine is improved, i.e., the engine can start in a short time.

Next, another embodiment of the present invention is explained.

Though the values of KTCR1 (timing for starting the scavenging operation) and KTCR2 (timing for terminating the scavenging operation) are both set at constant regardless of conditions of the engine, the amount of residual fuel varies according to the conditions of the engine in the actual operation of the engine. For example, if the cooling water temperature or the inlet air temperature is high, the conditions of the vaporization of the fuel in the cylinders is improved. Therefore, when the cooling water temperature or the inlet air temperature is high, the engine may start in a shorter time than when these temperatures are low. Therefore, if the engine does not start in a short time even though the cooling water temperature or the inlet air temperature is high, the possibility of the engine being started by further continuing the cranking operation is low. In this case, it is preferable to start the scavenging operation of the engine earlier to, thereby adjust the air-fuel ratio in the cylinders. Namely, in this case, it is preferable to set the value of KTCR1 smaller than that when the cooling water temperature or inlet air temperature is low.

Similarly, when the cooling water temperature or the inlet air temperature is high, the residual fuel in the cylinders vaporizes more easily. Therefore, the residual fuel in the cylinders can be expelled from the cylinders by the scavenging operation in a short time. In this case it is also preferable to terminate the scavenging operation earlier to, thereby prevent the air-fuel ratio in the cylinders from becoming excessively lean. Namely, in this case, it is preferable to set the value of KTCR2 smaller than that when the cooling water temperature or inlet air temperature is low.

Further, the engine speed during the cranking operation (cranking speed) varies in accordance with the battery voltage. When the battery voltage is high, the number of fuel injections per unit time increases since the cranking speed is higher than that when the battery voltage is low. Thus, the total amount of the fuel supplied to the engine increases as the cranking speed becomes higher even if the cranking time is the same. Accordingly, the amount of the residual fuel in the cylinders becomes larger when the cranking speed is high. Therefore, it is preferable to start the scavenging operation earlier when the cranking speed is high, than when the cranking speed is low.

In this embodiment, the values of KTCR1 and KTCR2 (start and stop timing of the scavenging operation) in FIG. 3 are changed in accordance with the cooling water temperature, inlet air temperature, and the cranking speed.

Further, the amount of the residual fuel in the cylinders varies in accordance with the amount deposits accumulated on the wall surface of the cylinder inlet port. Generally, when the fuel is injected in the inlet port of the cylinder, a portion of the injected fuel attaches to the wall surface of the inlet port and is held thereon. When the engine starting operation begins, the wall surface is dry, i.e., no fuel is held thereon. Therefore, a portion of the fuel injected to the inlet port during the starting operation is used for increasing the amount of the fuel attached to the wall surface, and only the remaining portion of the injected fuel is introduced into the cylinder. The maximum amount of the fuel attached to the wall surface and held thereon is determined by the conditions such as a wall surface roughness and the fuel injection amount etc., and the amount of the fuel attached to the wall surface does not exceed this maximum value. Therefore, once the amount of the fuel attached to the wall surface reaches this maximum value, it does not increase any more, and all of the fuel injected to the inlet port is introduced into the cylinder.

Considering the amount of the fuel attached to the wall of the inlet port and held thereon, the actual value of the total amount of the fuel supplied to the cylinders during the starting operation equals the total amount of the fuel injected during the starting operation less the amount of the fuel held on the wall surfaces of the inlet ports of the cylinders. However, when deposits (such as dust in the fuel and carbon particles) are accumulated on the wall surface of the inlet port, the maximum amount of the fuel held on the wall surface increases since the roughness of the wall surface increases due to the accumulation of deposits. Therefore, when the amount of deposits on the wall surface of the inlet port increases, the total amount of the fuel actually supplied to the cylinders becomes smaller even if the cranking time is the same. Namely, the amount of the residual fuel in the cylinder becomes smaller as the amount of the deposits increases. Therefore, it is preferable to start the scavenging operation later as the amount of the deposits on the wall of the inlet port increases.

Considering above, the values of KTCR1 and KTCR2 are set larger value to thereby delay the timing of starting and stopping of the scavenging operation.

The amount of the deposits on the wall of the inlet port is estimated by monitoring the change in the air-fuel ratio of the exhaust gas during acceleration of the vehicle in the normal operation, and the estimated amount is stored in the backup RAM 106 in this embodiment. The fuel injection amount TAU in the normal operation of the engine (i.e., the operation of the engine after it has started) is calculated by the following formula in this embodiment.

$$TAU=Q/NE\times\alpha\times FAF+FMW.$$

In the above formula, Q/NE is the amount of the inlet air per one revolution of the engine, $\alpha$ is a conversion factor (constant value) to convert the amount Q/NE to the fuel injection amount so that $Q/NE\times\alpha$ becomes equal to a fuel injection amount (base fuel injection amount) which makes the air-fuel ratio of the air-fuel mixture in the cylinders stoichiometric. Further, FAF is a correction factor for controlling the air-fuel ratio of the exhaust gas at the stoichiometric air-fuel ratio, and determined by a feedback control based on the output of the $O_2$ sensor 13 in FIG. 1. By the feedback control, the value of the correction factor FAF is adjusted in such a manner that the actual fuel injection amount $Q/NE\times\alpha\times FAF$ makes the air-fuel ratio of the exhaust gas stoichiometric. Therefore, even when the characteristics of the components in the fuel injection system (such as fuel injection valves) have changed, the air-fuel ratio of the exhaust gas flowing into the catalytic converter 12 (FIG. 1) is maintained at the stoichiometric air-fuel ratio.

FMW is a correction factor for adjusting the fuel injection amount TAU in accordance with the amount of the fuel attached on the wall of the inlet port. As explained before, a portion of the fuel injected attaches to the wall of the inlet port and is held thereon, and the maximum amount of the fuel held on the wall surface varies according to the fuel injection amount and the amount of the deposits on the wall surface. When the vehicle is accelerated, the fuel injection amount is increased. Accordingly, the maximum amounts of the fuel which can be held on the wall also increases. Therefore, a portion of the injected fuel is used for increasing the amount of the fuel held on the wall surface to the maximum value during the acceleration, and the amount of the fuel introduced into the cylinders becomes smaller than the amount of the injected fuel. This temporarily causes the air-fuel ratio of the exhaust gas to be lean compared to the stoichiometric air-fuel ratio even if the fuel injection amount is adjusted by the feedback correction factor FAF.

FMW is a correction factor for adjusting the fuel injection amount TAU to prevent the air-fuel ratio of the exhaust gas from becoming lean during the acceleration, and is given by the following formula.

$$FMW=FMWB\times(1+KDPC)$$

FMWB is a base correction factor which corresponds the changes in the maximum amount of the fuel attached to the wall in accordance with the change in the fuel injection amount when no deposits are accumulated on the wall surface (i.e. clean wall condition). In this embodiment, the maximum amount of the fuel which can be held on the wall of the inlet port in the clean wall condition QMW is measured under various combinations of fuel injection amount TAU and engine speed NE. The value of QMW is stored in the ROM 104 in the control circuit 10 in a form of a numerical table based on TAU and NE which is similar to that in FIG. 2. When the fuel amount TAU is calculated, the control circuit 10 determines the value of QMW from this numerical table using the calculated value of TAU and NE, and calculates the difference between QMW and $QMW_{i-1}$. $QMW_{i-1}$ is a value of QMW based on the fuel injection amount $TAU_{i-1}$ which is the fuel injection amount when the fuel injection amount was last calculated. The value of the base correction factor FMWB is calculated by $FMWB=QMW-QMW_{i-1}$. Namely, the value FMWB corresponds to the amount of the fuel required for increasing the amount of the fuel held on the inlet port wall.

KDPC is a factor which corresponds the amount of the deposits accumulated on the inlet port wall surface. When no deposits are accumulated on the wall surface, the air-fuel ratio of the exhaust gas can be maintained at the stoichiometric air-fuel ratio during the acceleration by adding FMW to the calculated fuel amount $Q/NE\times\alpha\times FAF$. However, when the amount of the deposits on the inlet port wall increases, the maximum amount of the fuel which can be held by the wall also increases, and value FMW becomes insufficient to maintain the air-fuel ratio of the exhaust gas at the stoichiometric air-fuel ratio. Namely, when the amount of the deposits increases, the air-fuel ratio of the exhaust gas becomes lean during the acceleration even though the amount of fuel is corrected by the base correction factor FMWB. In this embodiment, control circuit 10 measures the length of the period in which air-fuel ratio of the exhaust gas becomes lean during the acceleration, and increases the value of KDPC in accordance with the measured length of the lean air-fuel ratio period. By this operation, the value of KDPC becomes larger as the length of the lean air-fuel ratio period increases. The control circuit 10 stores the value of KDPC in the backup RAM 106, and calculates the value of FMW by the formula explained above using the stored value of KDPC so that the increment of the fuel injection during the acceleration becomes larger as the amount of deposits increase.

In this embodiment, the value of KDPC stored in the backup RAM 106 is used as a parameter representing the amount of deposits accumulated on the inlet port wall, and the values of KTCR1 and KTCR2 are changed in accordance with the value of KDPC.

Figure 4:
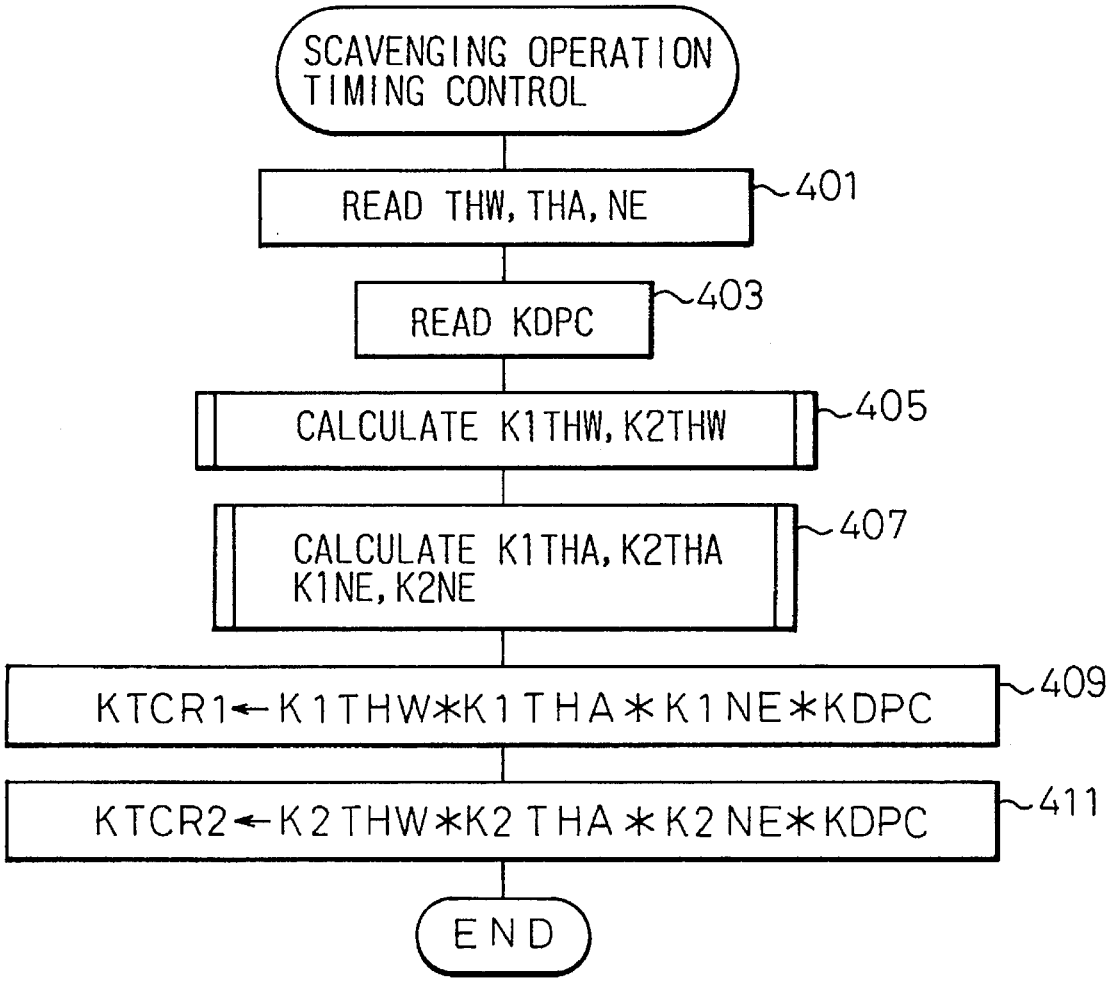
FIG. 4 is a flowchart showing a routine for calculating the length of a scavenging operation period.

FIG. 4 is a flowchart illustrating a routine for setting the values of KTCR1 and KTCR2, i.e., setting the length of the period of the scavenging operation according to the present embodiment. This routine is executed by the control circuit 10, separately from the main routine, at predetermined intervals.

Figure 5:
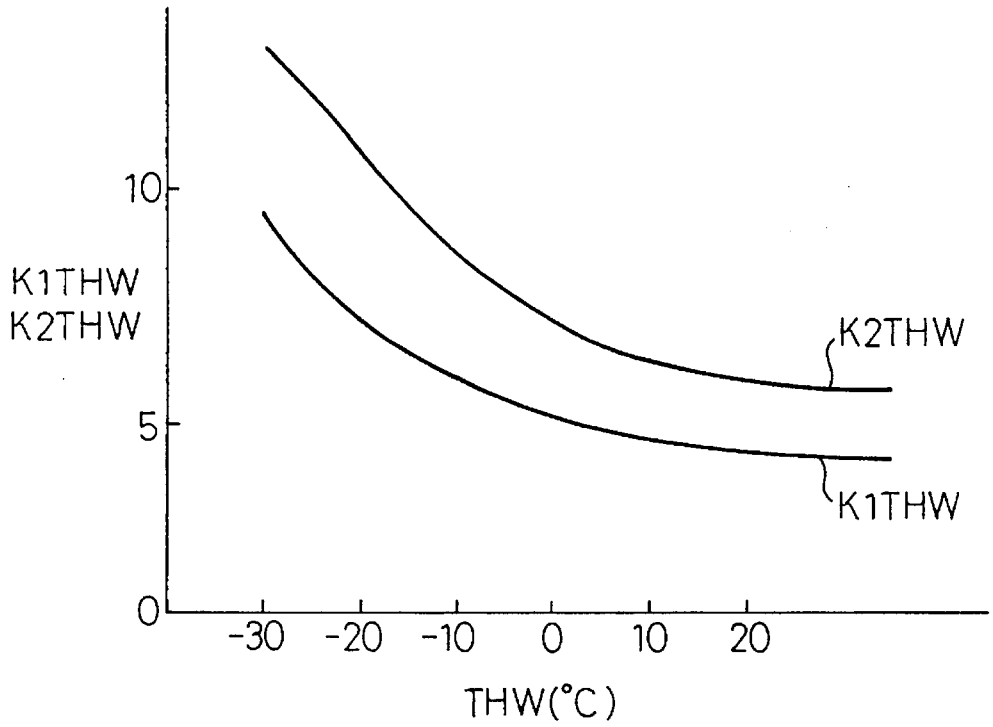
FIGS. 5 through 7 are graphs showing the settings of constants used in the routine in FIG. 4.

In FIG. 4, at step 401, the cooling water temperature data THW, inlet air temperature data THA and the engine speed data NE are read from the predetermined storage area of the RAM 105, and at step 403, the deposits accumulation factor KDPC is read from the backup RAM 106. Then, at step 405, K1THW and K2THW, which are base values determining the timing for starting the scavenging operation (KTCR1) and the timing for stopping the same (KTCR2), are calculated in accordance with the cooling water temperature THW. FIG. 5 illustrates the relationships between the K1THW, K2THW and THW. As shown in FIG. 5, the values K1THW and K2THW decrease as the cooling water temperature THW increases. Further, the difference between K2THW and K1THW also becomes smaller as THW increases. Namely, as the cooling water temperature THW becomes higher, the timing for starting the scavenging operation (K1THW) becomes earlier and the length of the scavenging operation (K2THW–K1THW) becomes shorter. In this embodiment, the values of K1THW and K2THW in FIG. 5 are stored in ROM 104 in the form of a numerical table based on the cooling water temperature THW, and the control circuit 10 calculates the values of K1THW and K2THW using this table at step 405.

Figure 6:
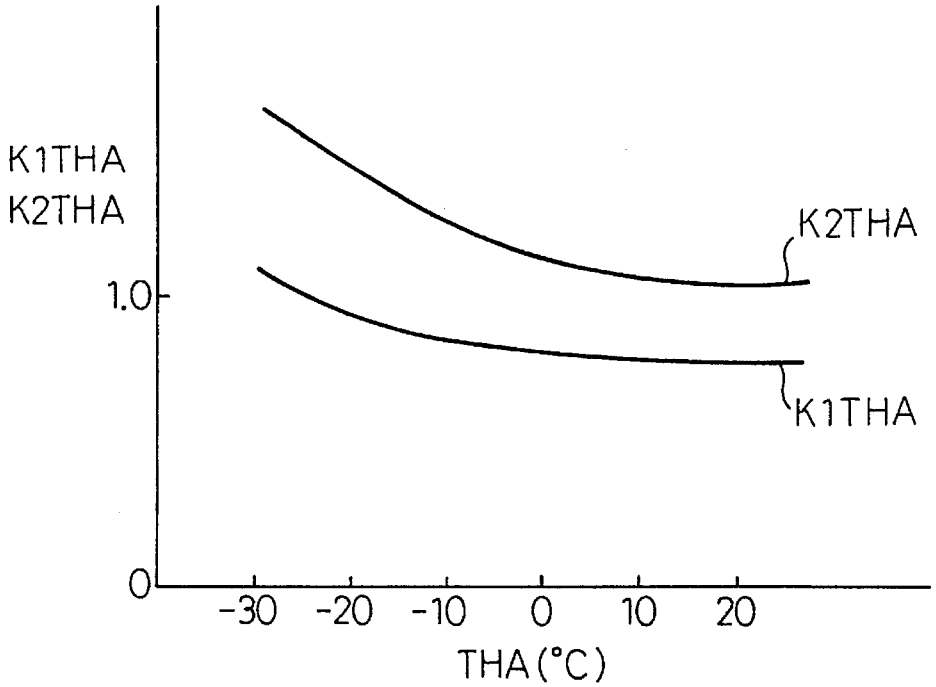
Figure 7:
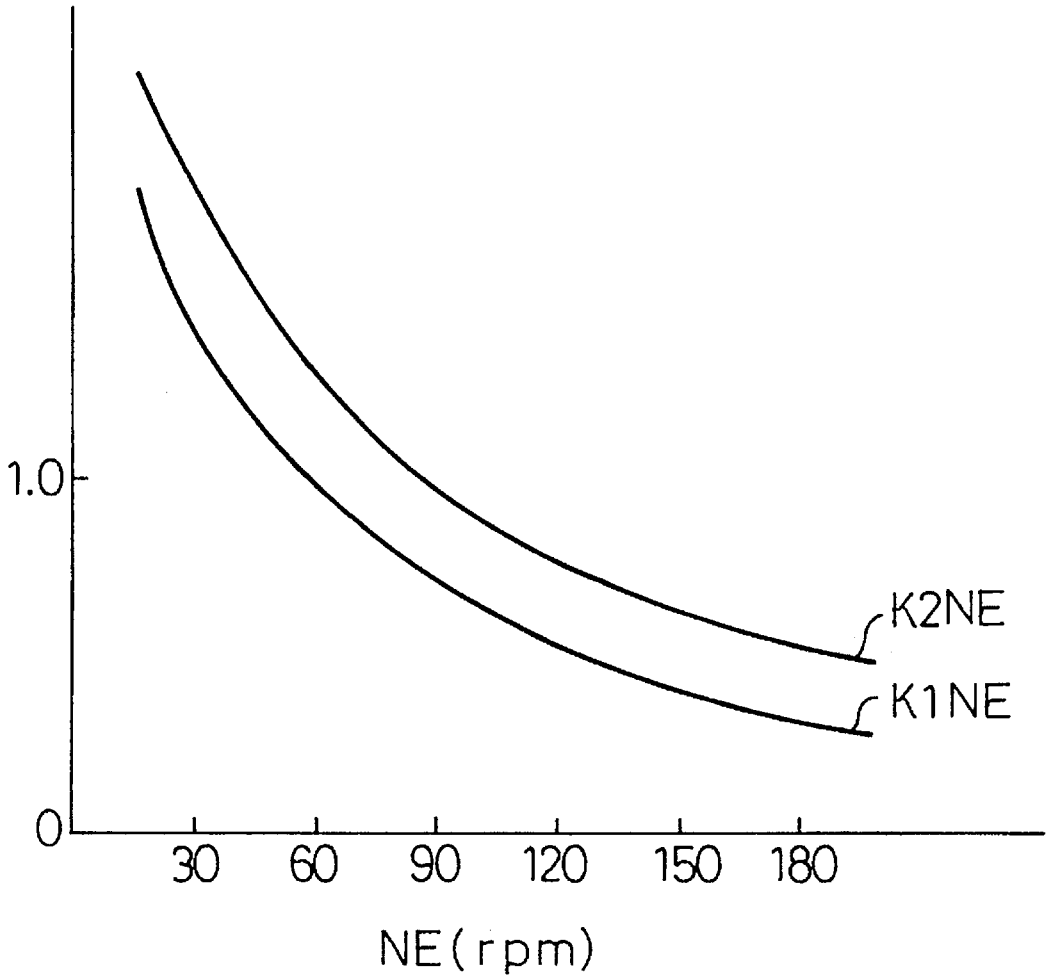

At step 407 in FIG. 4, correction factors K1THA, K2THA, K1NE and K2NE, which are used for correcting the base values K1THW and K2THW in accordance with the inlet air temperature THA and the engine speed NE, are calculated. FIGS. 6 and 7 show the relationships between the inlet air temperature correction factors K1THA, K2THA and the inlet air temperature THA and the relationships between engine speed correction factors K1NE, K2NE and the engine speed NE, respectively. As shown in FIG. 6, the inlet air temperature correction factors K1THA and K2THA both become smaller as the inlet air temperature THA becomes higher, and the difference between K2THA and K1THA also becomes smaller as the inlet air temperature becomes higher. Further, as shown in FIG. 7, the engine speed correction factors K1NE and K2NE both become smaller as the engine speed NE becomes higher. The values of K1THA and K2THA in FIG. 6 and the values of K1NE and K2NE in FIG. 7 are stored in the ROM 104 in the control circuit 10 as functions of THA and NE, respectively, and values of these correction factors are calculated at step 407 based on these functions.

At steps 409 and 411, the starting timing KTCR1 and the stopping timing KTCR2 of the scavenging operation are calculated using the following formulas.

$$KTCR1=K1THW\times K1THA\times K1NE\times KDPC$$

$$KTCR2=K2THW\times K2THA\times K2NE\times KDPC$$

When the values of KTCR1 and KTCR2 are calculated in this routine, the control circuit 10 executes the routine in FIG. 3 using the calculated values of KTCR1 and KTCR2 also in this embodiment. Therefore, the starting and stopping of the scavenging operation is adjusted in accordance with the values of KTCR1 and KTCR2.

As explained above, the starting timing and the stopping timing of the scavenging operation are adjusted in accordance with the conditions of the engine such as the amount of the deposits accumulated on the inlet port walls, cooling water temperature, inlet air temperature, and the engine speed (cranking speed) in this embodiment. Therefore, the startability of the engine is further improved by preventing the air-fuel ratio of the air-fuel mixture in the cylinders from becoming excessively rich or lean.

Though the amount of the deposits, cooling water temperature, inlet air temperature and engine speed are all used for adjusting the timing for starting and stopping the scavenging operation, the timing may be adjusted in accordance with one or more of these conditions.

Next, another embodiment of the present invention is explained with reference to FIG. 8.

In the above embodiments, cranking time is used as a parameter for representing the total amount of the fuel supplied to the engine during the starting operation. However, in the actual engine operation, there are cases in which the cranking time does not exactly correspond to the total amount of the fuel supplied to the engine. Therefore, especially in determining the starting timing of the scavenging operation, it is preferable to use the actual value of the amount of the fuel supplied to the engine. In this embodiment, the starting timing of the scavenging operation is determined based on the total amount of the actual fuel injection amount (TAUSTA) during the starting operation. Further, though the timing for stopping the scavenging operation is determined based on the cranking time in this embodiment, the cranking time from the beginning of the scavenging operation, instead of the cranking time from the beginning of the starting operation, is used for determining the timing for stopping the scavenging operation. This is, because the starting timing of the scavenging operation is determined by the actual fuel amount, the cranking time from the beginning of the starting operation to the beginning of the scavenging operation may vary in some cases, and the length of the scavenging operation also varies accordingly if the cranking time from the beginning of the starting operation is used for determining the timing for stopping the scavenging operation.

Figure 8:
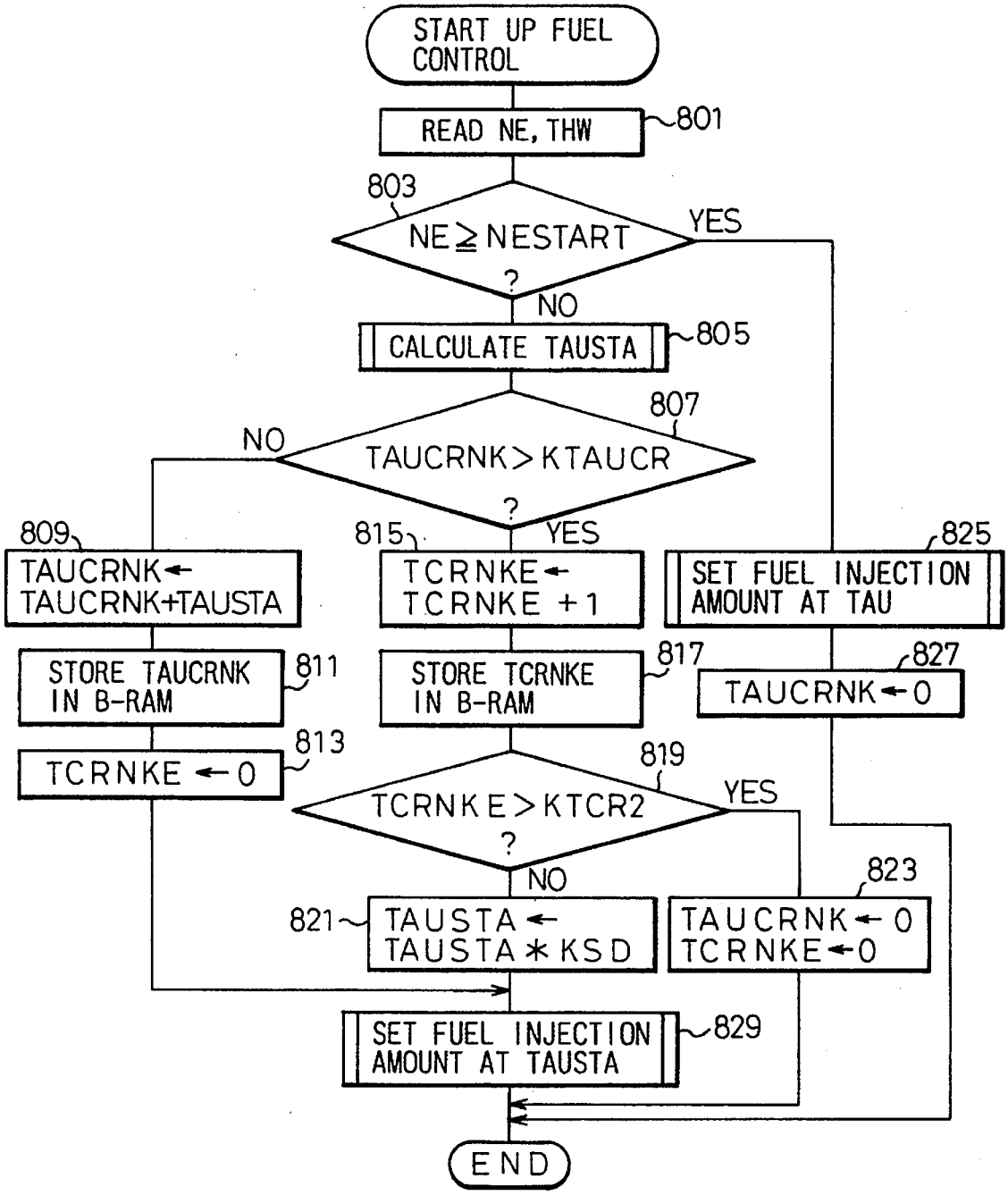
FIG. 8 is a flowchart showing another example of the start up fuel control routine.

In FIG. 8, steps 801, 803 and 805 are the steps for reading the cooling water temperature THW and speed NE, for determining whether the engine has started, and for calculating the normal start up fuel injection amount, respectively. These steps are essentially the same as steps 301, 303 and 305 in FIG. 3, and a detailed explanation is not repeated here.

At step 807 in FIG. 8, it is determined whether the total value of the fuel injection amount TAUCRNK since the starting operation started exceeds a predetermined value KTAUCR. KTAUCR is a value for determining the timing for starting the scavenging operation. If TAUCRNK does not exceed KTAUCR at step 807, steps 809 and 811 are executed to add the fuel injection amount TAUSTA to TAUCRNK, and the value of TAUCRNK after the addition of TAUSTA is stored in the backup RAM 106. Then, at step 813, the value of a counter TCRNKE is cleared. TCRNKE is a counter for determining the timing for stopping the scavenging operation as explained later. In this case, the normal start up fuel injection amount TAUSTA calculated at step 805 is preset in the down counter 108 at step 829. Therefore, the normal starting fuel injection amount is supplied to the engine from the beginning of the starting operation until the total amount of the fuel TAUCRNK supplied to the engine reaches the value KTAUCR. In this embodiment, KTAUCR is set at a constant value.

On the other hand, if TAUCRNK>KTAUCR at step 807, the scavenging operation of steps 815 through 821 is performed. Namely, the value of the counter TCRNKE is increased by 1 at step 815, and the value of TCRNKE after it is increased is stored in the RAM 104 at step 817. By executing steps 813 and 815, the value TCRNKE corresponds to the time lapsed since the start of the scavenging operation. At step 819, it is determined whether the value of TCRNKE exceeds KTCR2. If TCRNKE≦KTCR2 at step 819, i.e., if the length of the scavenging operation has not reached the predetermined time, the fuel injection amount TAUSTA is reduced at step 821, and the reduced fuel injection amount is preset in the down counter 108 at step 829, whereby the scavenging operation in which the fuel supply amount to the engine is reduced is performed. Further, if TCRNKE>KTCR2 at step 819, i.e., if the length of the scavenging operation exceeds a predetermined time, the values of the counter TCRNKE and the total amount of the fuel TAUCRNK are cleared at step 823, thereby the scavenging operation terminates and the fuel injection amount reverts to the normal start up fuel injection amount.

If the engine has started at step 803, the fuel injection amount is set at TAU (fuel injection amount in the normal operation) at step 825 and TAUCRNK is cleared at step 827.

By executing the routine in FIG. 8, the timing for starting and stopping the scavenging operation is adjusted in accordance with the total amount of the fuel actually supplied to the engine during the starting operation. Therefore, the scavenging operation is accurately controlled in accordance with the amount of the residual fuel in the cylinders, and the startability of the engine is further improved.

In the embodiment, the value of KTAUCR for determining the timing for starting the scavenging operation and/or the value of KTCR2 for determining the timing for stopping the scavenging operation may be changed in accordance with the conditions of the engine such as the amount of the deposits accumulated on the inlet port wall, cooling water temperature, inlet air temperature, and cranking speed to further improve the startability of the engine.

Figure 9:
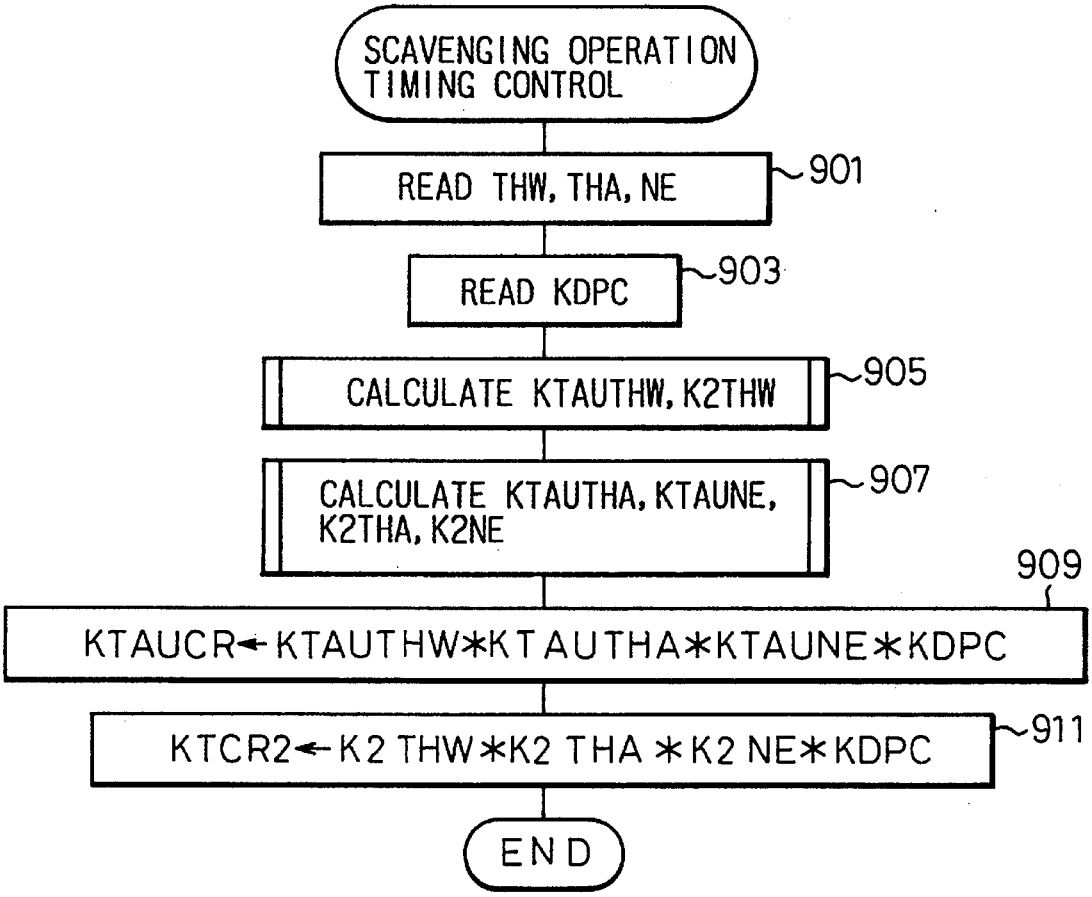
FIG. 9 is a flowchart showing another example of the start up fuel control routine.

FIG. 9 shows a flowchart of an embodiment in which both KTAUCR and KTCR2 are changed in accordance with the conditions of the engine. Since the flowchart in FIG. 9 is similar to the flowchart in FIG. 4, only the portions different from the flowchart in FIG. 4 are explained here.

Figure 10:
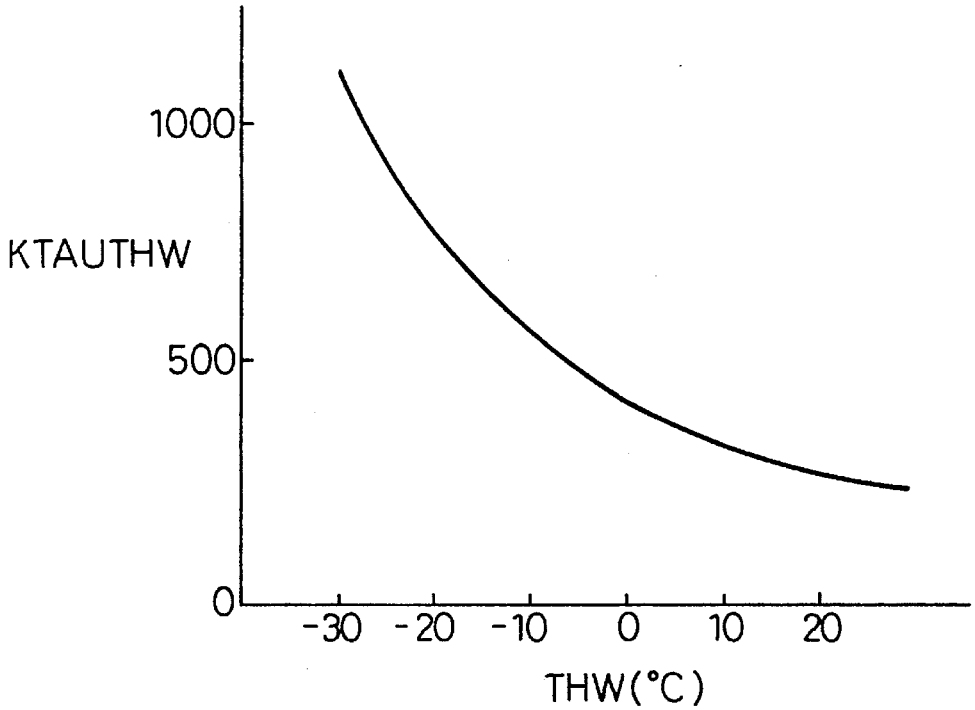
FIGS. 10 through 12 are graphs showing the settings of constants used in the routine in FIG. 9.

At step 905 in FIG. 9, a base value KTAUTHW, instead of K1THW in step 405 of FIG. 4, for determining the timing for starting the scavenging operation is calculated in accordance with the cooling water temperature THW. FIG. 10 is a drawing similar to FIG. 5 which illustrates the change in the value of KTAUTHW in accordance with the cooling water temperature THW. KTAUTHW changes in accordance with THW in the similar manner as K1THW in FIG. 5. Further, K2THW is also determined based on FIG. 5 in this embodiment.

Figure 11:
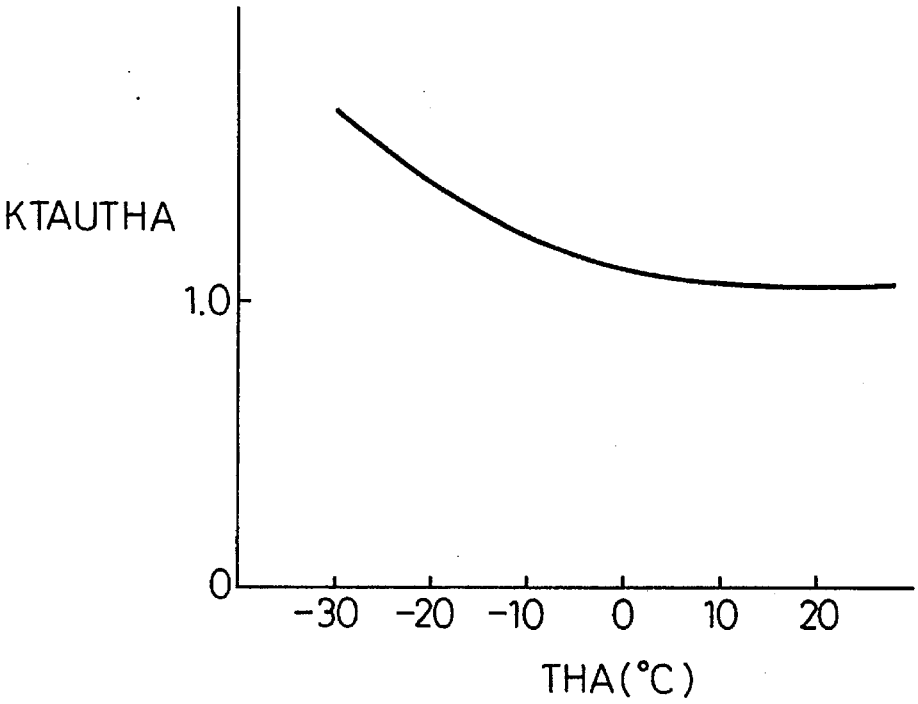
Figure 12:
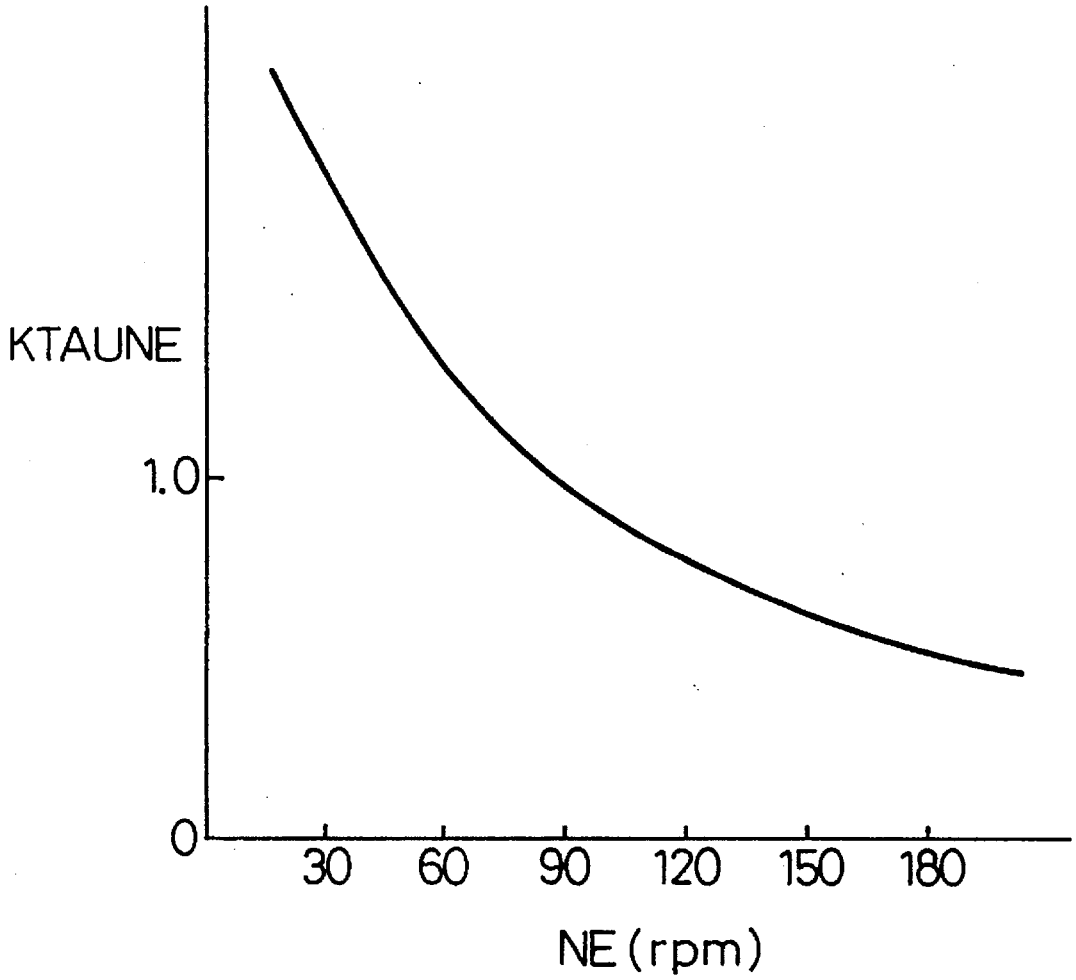

At step 907, an inlet air temperature correction factor KTAUTHA and an engine speed correction factor KTAUNE, instead of K1THA and K1NE in step 407 of FIG. 4, are calculated in accordance with the inlet air temperature THA and the engine speed NE, respectively. FIGS. 11 and 12 are drawings, similar to FIGS. 6 and 7, which illustrate the change in the values of KTAUTHA and KTAUNE in accordance with THA and NE. As seen from FIGS. 11, 12 and FIGS. 6, 7, KTAUTHA and KTAUNE change in a similar manner to K1THA and K1NE, respectively. K2THA and K2NE in step 907 are also determined, based on FIGS. 6 and 7, respectively, in this embodiment.

At step 909, KTAUCR is calculated by the following formula.

KTAUCR=KTAUTHW×KTAUTHA×KTAUNE×KDPC

Figure 13:
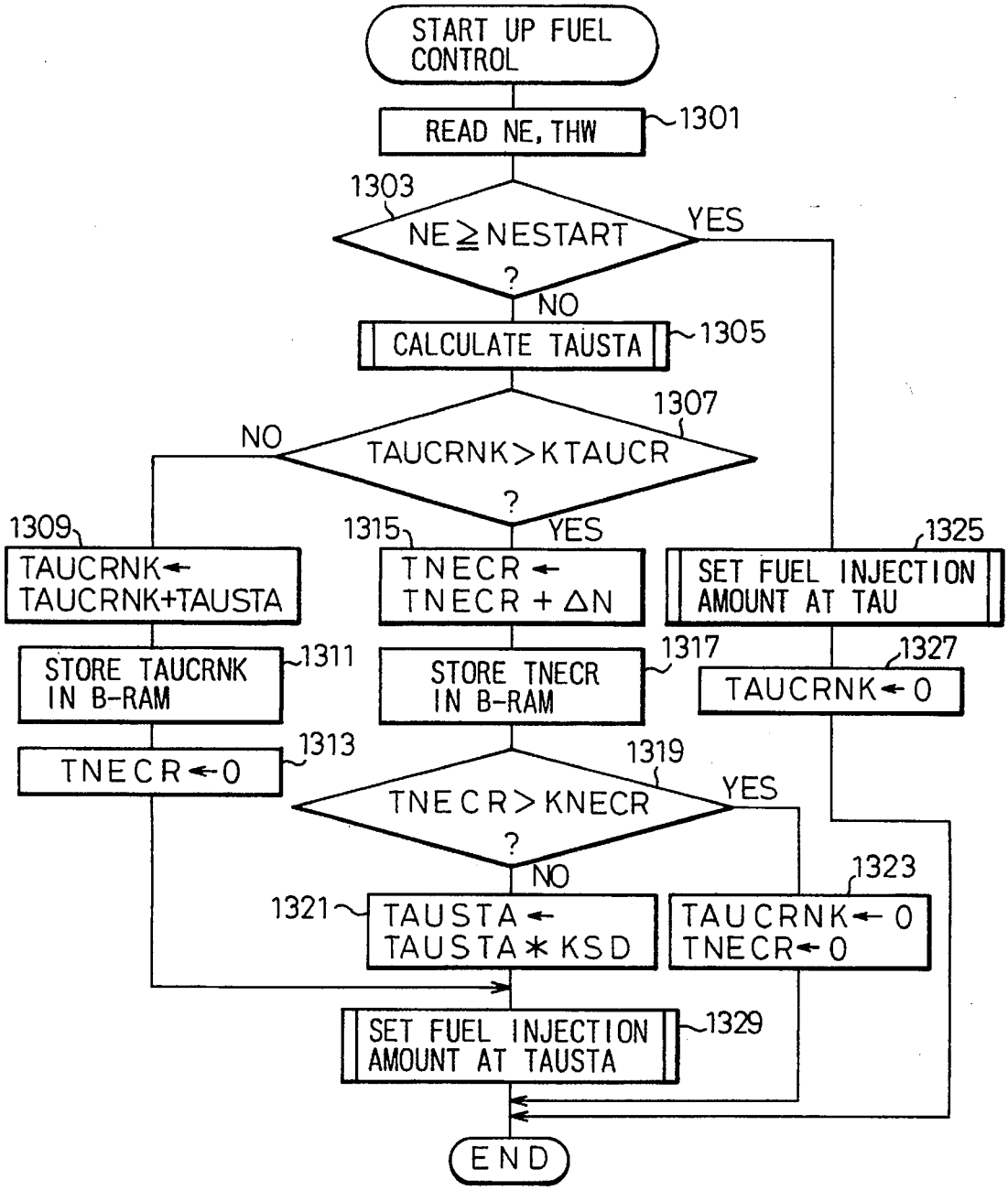
FIG. 13 is a flowchart showing another example of the start up fuel control routine.

In the embodiments explained above, the cranking time is also used as a parameter representing a total amount of the inlet air passing through the cylinders in order to determine the timing for stopping the scavenging operation. However, in a strict sense, the amount of the inlet air passing through the cylinders is determined by a total number of rotations of the engine during the scavenging operation, rather than the cranking time. Therefore, in order to determine the timing for stopping the scavenging operation accurately, it is preferable to use the number of rotations of the engine during the scavenging operation. FIG. 13 shows an example of the flowchart of a start up fuel control routine in which the timing for stopping the scavenging operation is determined based on the number of the rotations of the crankshaft of the engine.

The flowchart in FIG. 13 is similar to the flowchart in FIG. 8 except that a total number of rotations of the engine TNECR instead of TCRNKE in FIG. 8 is used. The increment ΔN of the counter TNECR in step 1315 represents a number of the rotations of the engine since the routine was last executed. In this embodiment, the control circuit 10 counts the number of rotations of the engine by a routine executed separately (not shown). KNECR in step 1319 is a predetermined value for determining the timing for stopping the scavenging operation. The value KNECR may be a constant, or alternatively, the value KNECR may be changed in accordance with the value KTAUCR for determining the timing for starting the scavenging operation. Since the value KTAUCR represents the total amount of the fuel supplied to the engine before the scavenging operation started, KTAUCR can be used as a parameter representing the amount of the residual fuel in the cylinders. Further, the value of KTAUCR is changed in accordance with the conditions of the engine as explained in FIG. 9. Therefore, when KTAUCR is set at a large value, it is also considered that a large amount of the residual fuel exists in the cylinders. In such a case, it is preferable to perform the scavenging operation longer. Considering the above, KNECR may be set at a value obtained by, for example, multiplying KTAUCR by a constant factor KCR. This is accomplished by calculating KNECR instead of KTCR2 at step 911 in FIG. 9 by using KNECR=KCR×KTAUCR.

Next, another embodiment of the present invention is explained with reference to FIG. 14. In this embodiment, the scavenging operation is performed for each cylinder separately, i.e., the timing for starting and stopping the scavenging operation is determined for the respective cylinders of the engine, and fuel injection amounts of the respective cylinders is adjusted separately to carrying out separate scavenging operations. As shown in FIG. 2, the normal start up fuel amount TAUSTA is determined in accordance with the cranking speed of the engine. Therefore, if the cranking speed fluctuates during the cranking operation, the amounts of the fuel supplied to the respective cylinders become different from each other, and accordingly, the amount of the residual fuel in the respective cylinders become different from each other. In such a case, optimum scavenging may not be obtained if the scavenging operations are performed for all the cylinders at the same time. To solve this problem, the timing for starting and stopping the scavenging operation is determined separately for each cylinder, and the scavenging operation is carried out separately for each cylinder in this embodiment.

Figure 14:
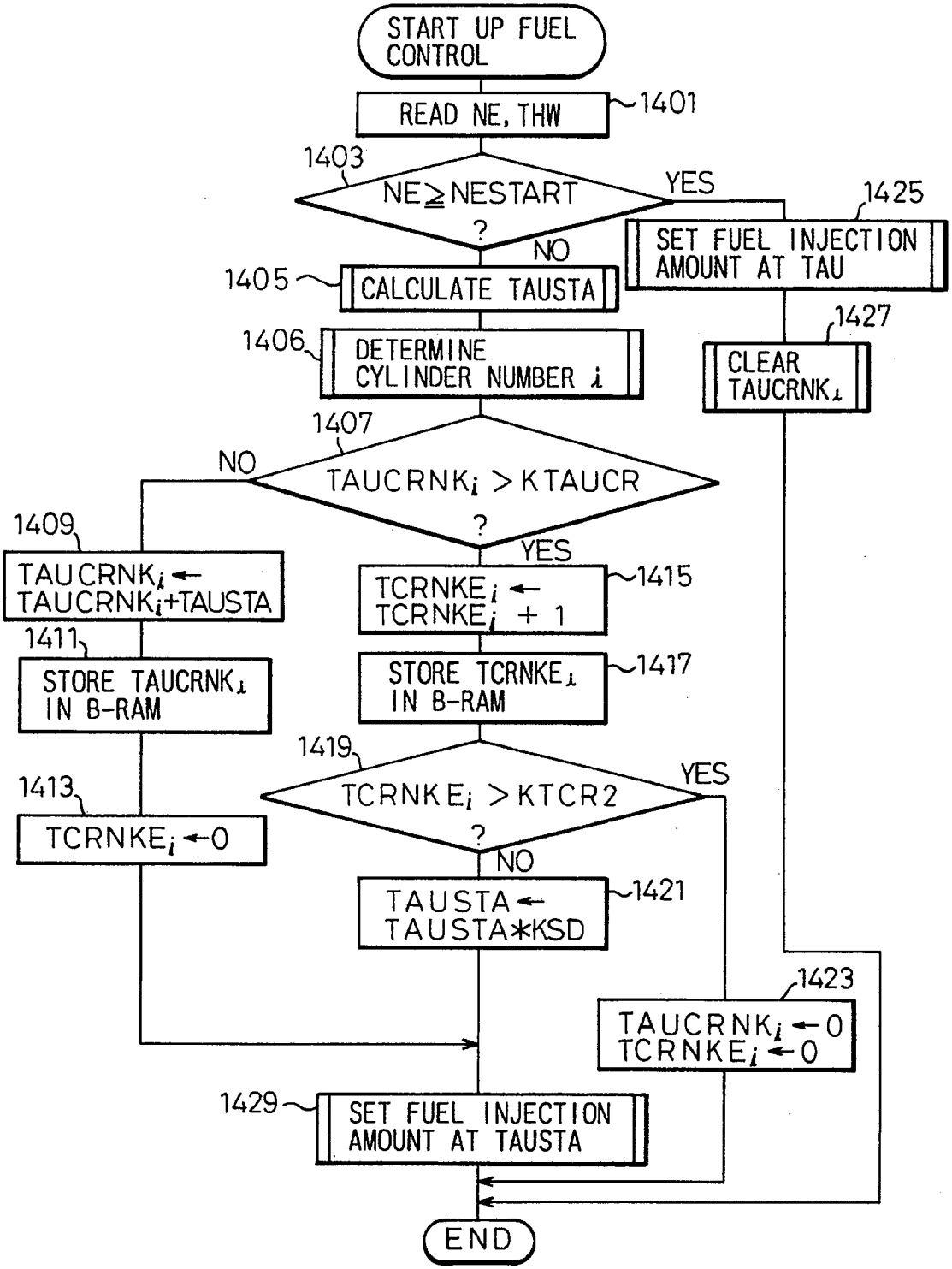
FIG. 14 is a flowchart showing another example of the start up fuel control routine.

FIG. 14 shows a flowchart of the start up fuel control in which the scavenging operation is performed separately for each cylinder. In this embodiment, steps 807 through 823 and step 829 are performed for each cylinder of the engine separately.

In FIG. 14, steps 1401 through 1405 are the same operations as that of steps 801 through 805 in FIG. 8. However, if the engine has started at step 1403, the counters TAUCRNK$_i$ (i=1, 2, 3, . . . ) which represent the total amount of the fuel supplied to the respective cylinders are all cleared at step 1427. The subscript i represents a cylinder number, and if the engine has four cylinders, for example, i takes the values 1 through 4.

In FIG. 14, after calculating TAUSTA at step 1405, the cylinder number of the cylinder in which fuel is to be injected is determined, and the value of the parameter i is set at that cylinder number. For example, if the fuel injection is to be carried out at cylinder number 2, the value of the parameter i is set at 2. When the cylinder number is determined at step 1406, the total amount of the fuel supplied to that cylinder TAUCRNK$_i$, is calculated at step 1409 and stored in the backup RAM 106 at step 1411. Further, incrementing of the counter TCRNKE$_i$, and storage of the TCRNKE$_i$ in the backup RAM 106 and determining of the timing for starting and stopping the scavenging operation for the cylinder are performed for that cylinder (steps 1415, 1417, 1407 and 1419, respectively). Though steps 1407 through 1423 are performed for each cylinder in this embodiment, these steps are essentially the same as those of steps 807 through 823. Therefore, a detailed explanation is not repeated here.

In the routine in FIG. 14, as explained above, the total amount of the fuel supplied to each cylinder TCRNKE$_i$ is calculated separately at the timing of the fuel injection of each cylinder, and the scavenging operation is carried out for each cylinder separately in accordance with the value of TCRNKE$_i$ of the respective cylinders. Therefore, scavenging operation suitable for the conditions of the respective cylinders are performed in this embodiment.

In this embodiment, the values of KTAUCR and KTCR2 may also be changed in accordance with the conditions of the engine as explained in FIG. 9, to further improve the startability of the engine.

Next, an example of variations of the embodiment in FIG. 14 is explained. The scavenging operation of the embodiment in FIG. 14 is carried out regardless of the firing in the respective cylinders unless the engine as a whole starts. However, if firing occurs in one or more cylinders, the firing is aborted if the scavenging operation is started, and the starting of the engine may be delayed unnecessarily. In the embodiment explained below, the control circuit 10 determines whether the firing occurs in the respective cylinders, and stops the scavenging operation of the cylinder in which the firing occurs. In this embodiment, the firing in the respective cylinders are determined based on the fluctuation of the rotating speed of the crankshaft of the engine. Namely, if the firing occurs in a cylinder, the rotating speed of the crankshaft increases during the explosion stroke of that cylinder. The control circuit 10 in this embodiment monitors the time required for the crankshaft to rotate a predetermined angle (for example, 30°) from the top dead center of the compression stroke of each cylinder by a firing detecting routine (not shown), and determines that the firing occurs in a cylinder when the monitored time for that cylinder becomes less than a predetermined value.

Figure 15:
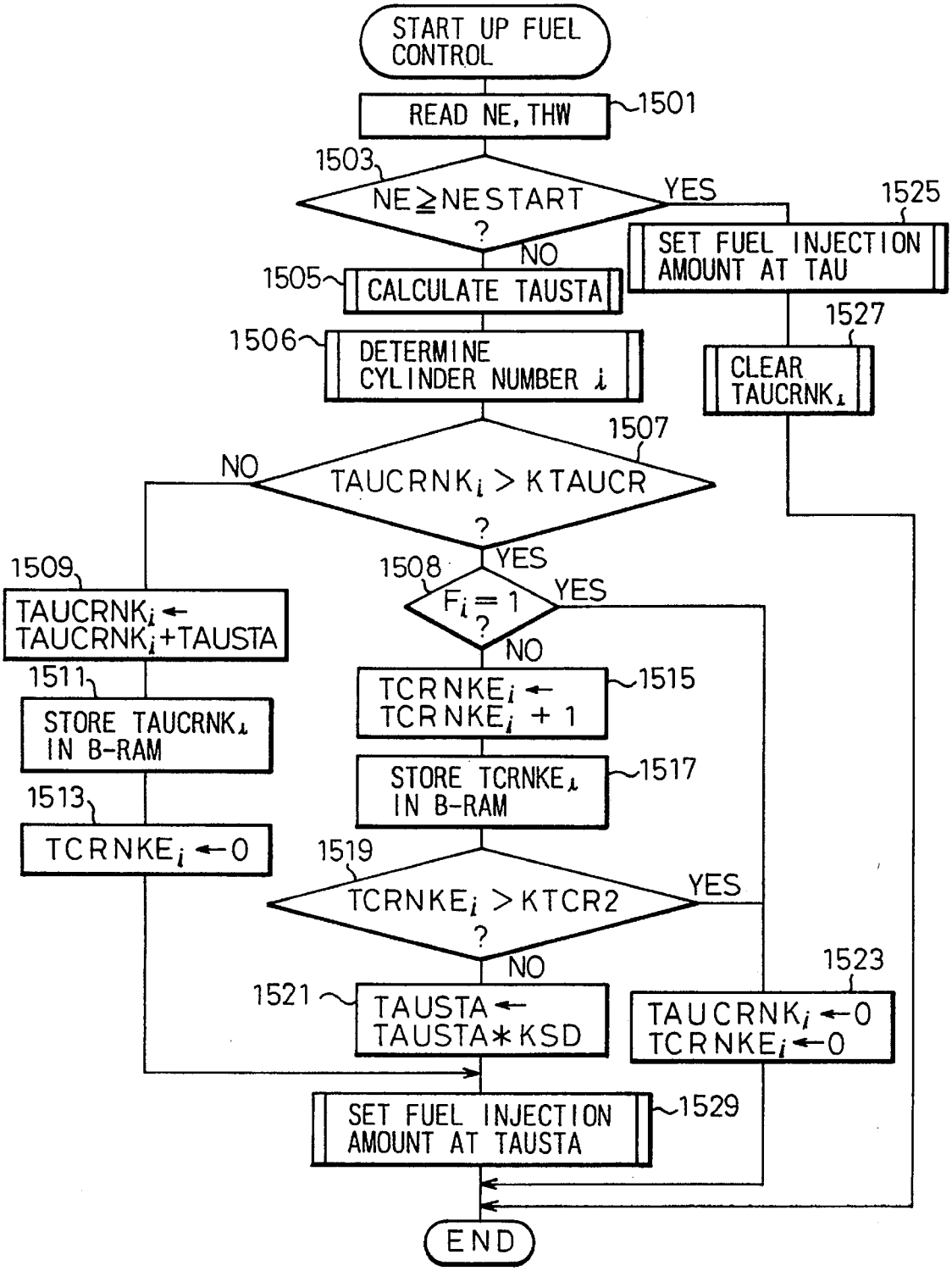
FIG. 15 is a flowchart showing another example of the start up fuel control routine.

FIG. 15 shows a flowchart of the embodiment in which the scavenging operations of the respective cylinders are controlled in accordance with the occurrence of the firing in the respective cylinders.

The flowchart in FIG. 15 is the same as that in FIG. 14, except that step 1508 is added between steps 1507 and 1515. At step 1508, it is determined whether the value of a flag $F_i$ is set at 1, and if $F_i$=1, the routine executes step 1523 to, thereby terminate the scavenging operation. $F_i$ is a flag set by the firing detecting routine, and $F_i$=1 indicates that firing has occurred in the cylinder number i. Therefore, by executing steps 1508 and 1523, the scavenging operation for a cylinder is immediately terminated when the firing occurs in that cylinder. Therefore, the startability of the engine is further improved.

Next, another embodiment is explained with reference to FIG. 16. In the previous embodiments, the amount of the fuel supplied to the cylinders is gradually decreased, from the normal start up fuel supply amount TAUSTA, during the scavenging operation by multiplying TAUSTA by the factor KSD in each execution of the routine. By this operation, the air-fuel ratio of the air-fuel mixture in the cylinders gradually shifts from a rich air-fuel ratio to a lean air-fuel ratio and passes through the air-fuel ratio range suitable for firing. However, according to the previous embodiments, the air-fuel ratio of the air-fuel mixture in the cylinders shifts to one direction only, i.e., a rich air-fuel ratio to a lean air-fuel ratio. Accordingly, the air-fuel ratio of the air-fuel mixture in the cylinder passes the suitable range for firing only once during the scavenging operation, and if firing does not occur in this period, firing never occurs in the rest of the scavenging operation period.

In consideration of above, the fuel supply amount to the cylinders is decreased and increased within the range not exceeding the normal start up fuel supply amount during the scavenging operation, to thereby shift the air-fuel ratio of the air-fuel mixture in the cylinders from lean condition to rich condition, as well as from rich condition to lean condition. By this operation, the air-fuel ratio of the air-fuel mixture in the cylinders passes the range suitable for firing several times during the scavenging operation, and the possibility of occurrence of firing becomes larger.

Figure 16:
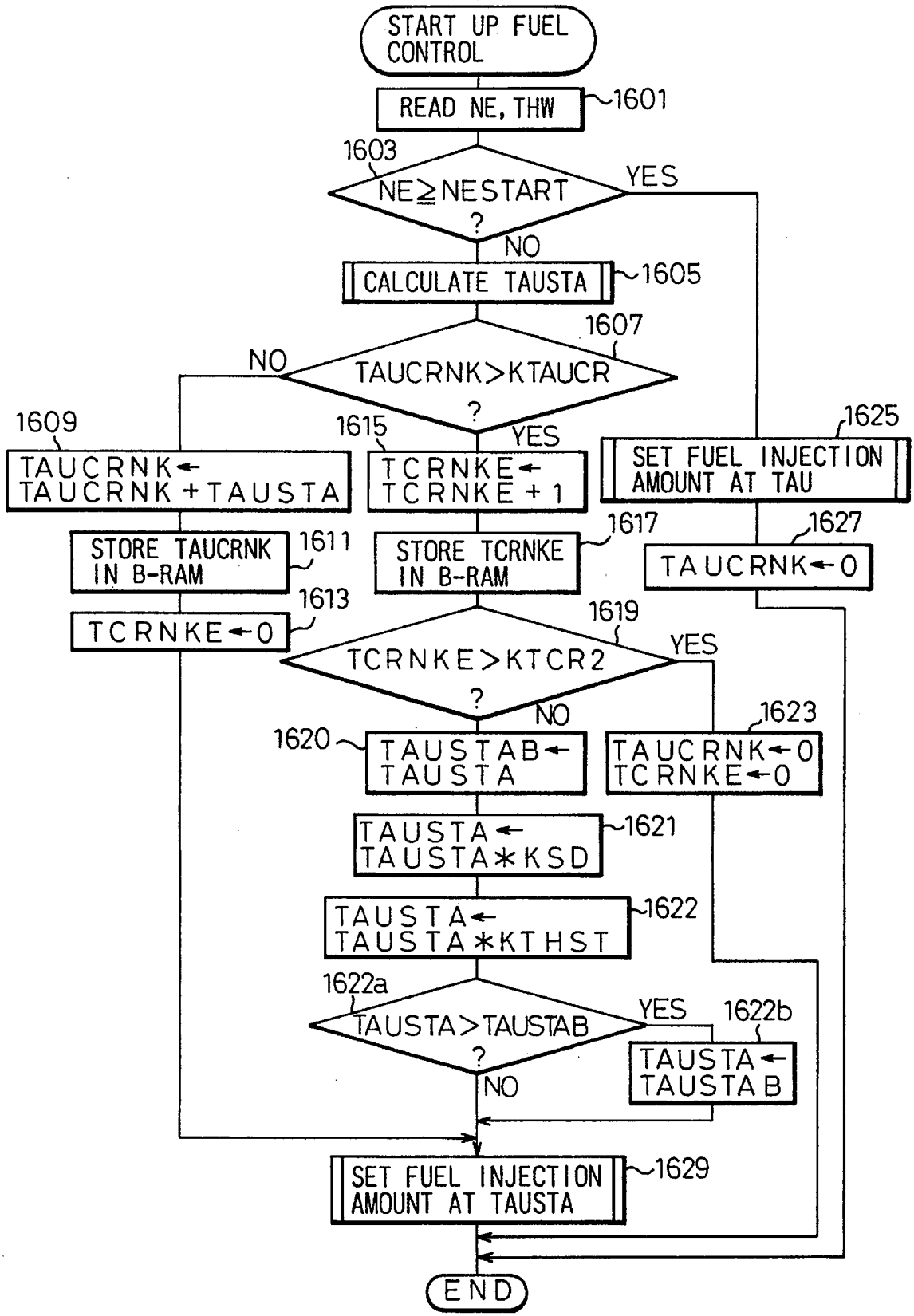
FIG. 16 is a flowchart showing another example of the start up fuel control routine.
Figure 17:
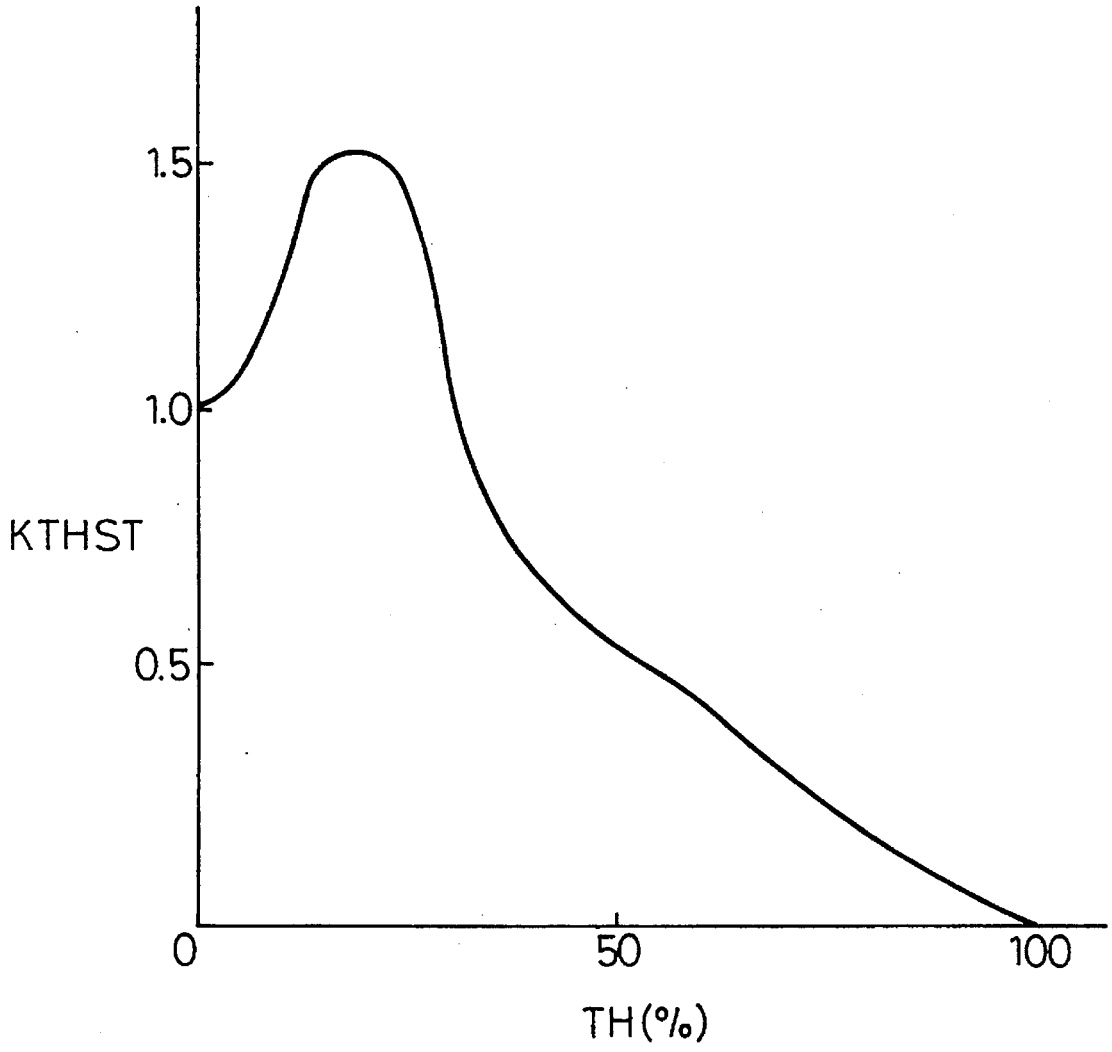
FIG. 17 is a graph showing a setting of the constant used in the routine in FIG. 16.

FIG. 16 shows a flowchart illustrating the start up fuel control of the present embodiment. In this embodiment, the scavenging operation is performed simultaneously in all the cylinders. The flowchart in FIG. 16 is the same as the flowchart in FIG. 8, except that, in FIG. 16, steps 1620, 1622, 1622*a* and 1622*b* are added. At step 1620 in FIG. 16, the value of the start up fuel injection amount TAUSTA is stored in the RAM 105 as TAUSTAB. At step 1622, the value of TAUSTA (after it is multiplied by the factor KSD at step 1621) is further multiplied by a factor KTHST. Therefore, at step 1629, TAUSTA is preset in the down counter 108 after it is multiplied by the factors KSD and KTHST. The value of the factor KTHST changes in accordance with the degree of opening of the throttle valve and, in some cases, becomes larger than 1.0. Therefore, the value of TAUSTA preset in the down counter at step 1629 is restricted to the start up fuel supply amount TAUSTAB at steps 1622*a* and 1622*b*. TAUSTAB is the amount of the start up fuel supply amount calculated and stored at steps 1605 and 1620. The value of the factor KTHST is determined in accordance with the degree of opening TH of the throttle valve 16. FIG. 17 shows the relationship between the values of KTHST and TH. As seen from FIG. 17, the value of KTHST is 1.0 when the degree of opening of the throttle valve TH is 0 (i.e., when the throttle valve is fully closed), and KTHST increases as TH becomes larger when TH is relatively small. Then, after it takes the maximum value of about 1.5, KTHST begins to decreases as TH becomes larger and becomes 0 at TH=100%. Though the value of the factor KSD is set at a constant value between 0 and 0.2 in the previous embodiments, it is preferable to set the value of KSD in this embodiment (step 1621) at relatively large value (for example, between 0.1 and 0.5) so that the air-fuel ratio changes in a wide range during the scavenging operation.

As explained above, the amount of the fuel supplied to the engine changes within a range smaller than the normal start up fuel supply amount, in accordance with the degree of opening of the throttle valve 16, in this embodiment. Usually, the driver of the vehicle repeats depressing and releasing of the accelerator pedal during the starting operation if the engine does not start after a certain period of cranking. Therefore, by changing the amount of the fuel supply according to degree of opening of throttle valve (i.e., the amount of depressing of the accelerator pedal), the amount of the fuel supply increases and decreases during the scavenging operation, and the air-fuel ratio of the air-fuel mixture in the cylinders passes the suitable range for firing repeatedly. Thus, according to the present embodiment, the startability of the engine is further improved.

Though the factor KTHST, the value of which changes in accordance with the degree of opening TH of the throttle valve, is used in order to change the fuel supply amount during the scavenging operation, other methods can be used for this purpose. For example, the fuel supply amount during the scavenging operation may be switched alternately between the value TAUSTA calculated at step 1605 and the reduced amount TAUSTA×KSD calculated at step 1621 periodically. (In this case, the factor KTHST is not used.) Further, in this case, it is preferable to set the length of the period in which the fuel supply amount is reduced (TAUSTA×KSD) longer than, or equal to the length of the period in which normal amount of start up fuel (TAUSTA) is supplied to the engine in order to change the air-fuel ratio in the cylinders over a wide range.

Next, another embodiment is explained with reference to FIG. 18. In the previous embodiments, the fuel supply amount to the engine reverts to the normal starting fuel supply amount after the residual fuel in the cylinders is expelled by the scavenging operation. However, if the engine did not start with the calculated normal start up fuel supply amount TAUSTA in the previous cycle, there is a possibility that the calculated amount TAUSTA is not appropriate for some reason. In such a case, if the fuel supply amount is reverted to TAUSTA after scavenging operation, the engine may fail to start again. In view of this problem, the fuel supply amount to the engine is gradually increased until it reaches the calculated normal start up fuel supply amount TAUSTA after scavenging operation in this embodiment. By gradually increasing the fuel supply amount instead of immediately reverting it to the normal start up fuel supply amount, the increasing fuel supply amount passes an optimum amount before it reaches the calculated normal start up fuel supply amount. Thus, even if the calculated normal start up fuel supply amount is not appropriate, the optimum amount of the fuel is supplied to the engine in the starting cycle after the scavenging operation. Therefore, the possibility that the engine will start after the scavenging operation becomes high even if the calculated normal start up fuel supply amount is not appropriate.

Figure 18:
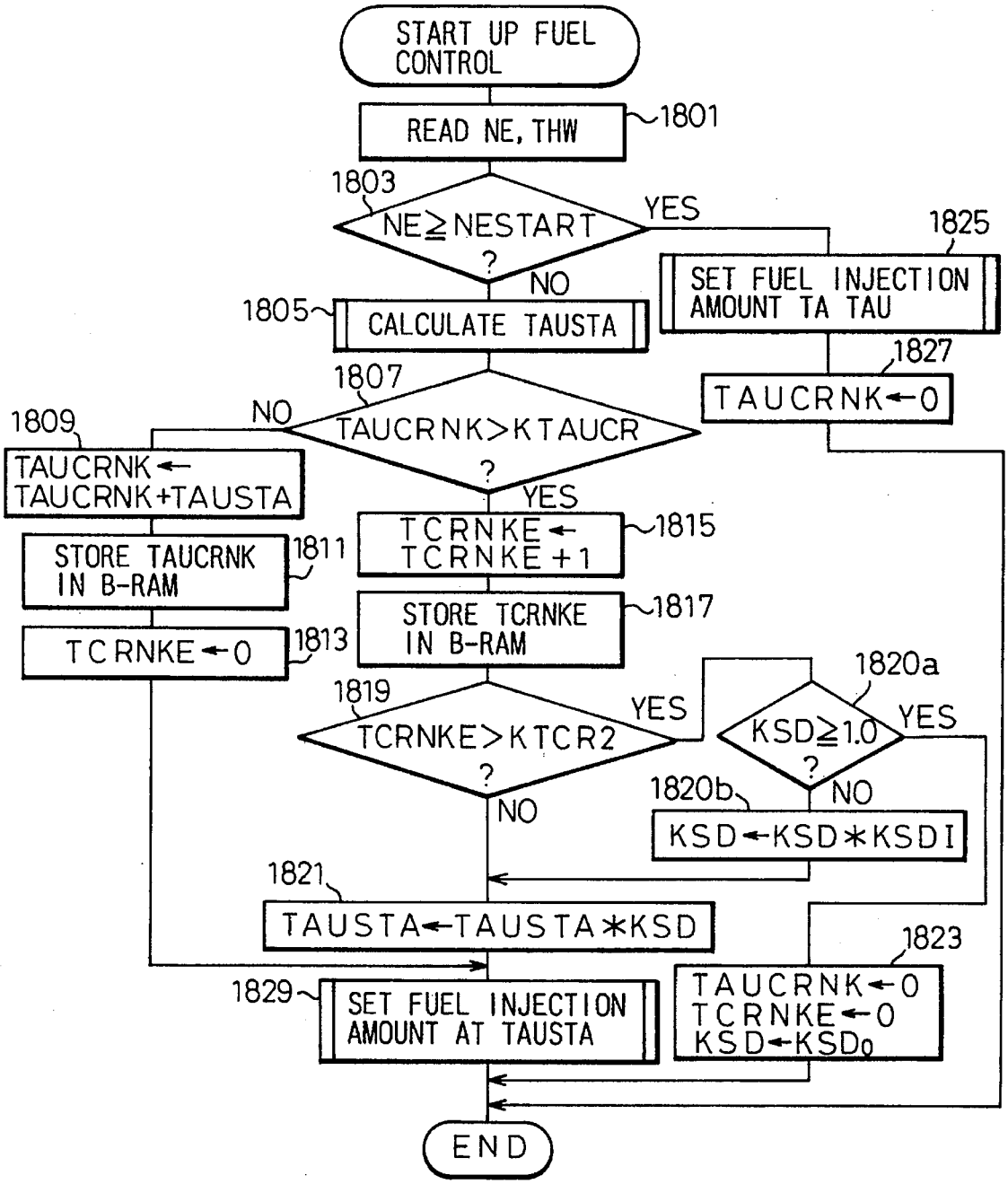
FIG. 18 is a flowchart showing another example of the start up fuel control routine.

FIG. 18 is a flowchart illustrating an embodiment of the start up fuel control in which the fuel supply amount to the engine is gradually increased after the scavenging operation. In this embodiment, the control for gradually increasing the fuel supply amount is added to the embodiment in FIG. 8. In the flowchart in FIG. 18, steps 1820*a* and 1820*b* are added to the flowchart in FIG. 8, and an operation for resetting the value of the factor KSD to its initial value $KSD_0$ is added at step 1823.

As shown by FIG. 18, the scavenging operation is carried out also in this embodiment when the value of the counter TAUCRNK exceeds the predetermined value KTAUCR, and the scavenging operation is terminated when a predetermined time has lapsed. However, in this embodiment, the fuel supply amount is gradually increased when the scavenging operation is completed by gradually increasing the value of the factor KSD. Namely, in FIG. 18, when TCRNKE>KTCR2 at step 1819, the routine proceeds to step 1820*a* which determines whether the value of KSD is larger than or equal to 1.0. If the value of KSD is smaller than 1.0 at step 1820*a*, the value of KSD is increased by multiplying it by a increasing factor KSDI at step 1820*b*, and this increased value of KSD is used for calculating the fuel supply amount TAUSTA at step 1821.

In this embodiment, the value of KSD is set at its initial value $KSD_0$ during the scavenging operation (step 1823). The initial value $KSD_0$ is set at a constant value between, for example, 0.1 and 0.5 in this embodiment, and the value of the increasing factor KSDI is also set at a constant value between, for example, 1.05 and 1.2. Therefore, the value of the factor KSD is gradually increased after the scavenging operation is completed (i.e., TCRNKE>KTCR2 at step 1819) every time the routine is executed (i.e., about every 10 ms) at step 1820*b* until the value of KSD reaches 1.0 (step 1820*a*). Accordingly, the fuel supply amount calculated at step 1821 also gradually increases after the scavenging operation is completed. Further, when the value of the factor KSD reaches 1.0, i.e., when the fuel supply amount calculated at step 1821 reaches the normal start up fuel supply amount, the values of the counters TAUCRNK, TCRNK are cleared and the value of the factor KSD is reset to its initial value $KSD_0$ at step 1823. Therefore, when the scavenging operation is performed next, the value of the factor KSD is set at $KSD_0$.

As explained above, according to the present embodiment, the fuel supply amount is gradually increased when the scavenging operation is completed. Therefore, even if the calculated normal start up fuel supply amount TAUSTA is not appropriate for some reason, the possibility that the engine will start after the scavenging operation becomes greater.

Next, another embodiment of the present invention is explained. In the embodiment in FIG. 18, the value of TAUCRNK is cleared when the fuel supply amount after the scavenging operation reaches the normal start up fuel supply amount (FIG. 18, steps 1820*a* and 1823). However, in this embodiment, the value of TAUCRNK is cleared immediately after the scavenging operation is completed, and the calculation of the value of TAUCRNK also starts immediately after the scavenging operation is completed. As explained before, the value of TAUCRNK is obtained by accumulating the fuel supply amount TAUSTA and it represents the total amount of the fuel supplied to the engine. Therefore, by starting the accumulation of TAUSTA in TAUCRNK immediately after the scavenging operation is completed, the gradually increased fuel supply amount after the scavenging operation is incorporated into the value of TAUCRNK, and the value of TAUCRNK represents the total amount of the fuel supplied after the scavenging operation more accurately. By determining the timing for starting and stopping the scavenging operation using the value of TAUSTA obtained by the above method, an accurate start up fuel control, reflecting the actual air-fuel ratio in the cylinder can be performed.

Figure 19:
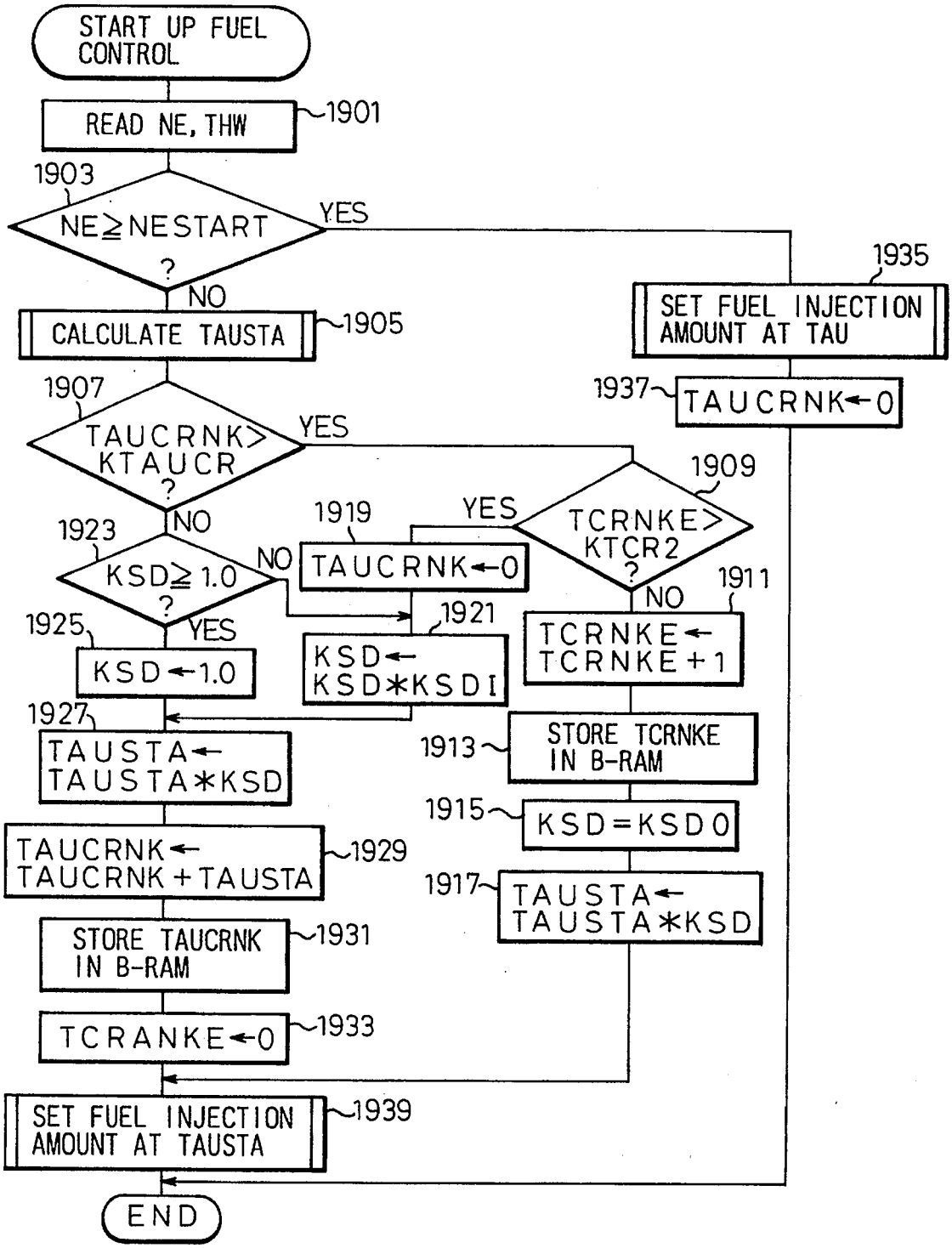
FIG. 19 is a flowchart showing another example of the start up fuel control routine.

FIG. 19 shows a flowchart of the start up fuel control in which the gradually increasing value of TAUSTA is accumulated in TAUCRNK. In FIG. 19, steps 1901 to 1907 are the same operations as those of steps 1801 to 1807 in FIG. 18. Further, when TAUCRNK≦KTAUCR at step 1907, steps 1923 to 1939 are executed. In these steps, the fuel supply amount is reduced (step 1927), and the value of the fuel supply amount after it is reduced is accumulated in TAUCRNK (step 1929). As explained later, when the condition TAUCRNK≦KTAUCR is satisfied at step 1907, the value of KSD is always set at 1.0 by steps 1923 and 1925. Therefore, the normal start up fuel supply amount TAUSTA calculated at step 1905 is used at steps 1929 through 1939 when TAUCRNK≦KTAUCR at step 107.

When the value of TAUCRNK is larger than the value KTAUCR at step 1907, the value of the counter TCRNKE is increased by 1 at step 1911, and the scavenging operation of steps 1915 and 1917 are performed until the value of the counter TCRNKE becomes larger than the value KTCR2 (step 1909). As explained before, the value KTCR2 corresponds to the timing for terminating the scavenging operation. In the scavenging operation by steps 1915 and 1917, since the value of the factor KSD is set at its initial value $KSD_0$ (step 1915), the fuel supply amount to the engine is reduced.

If TAUCRNK>KTCR2 at step 1909, i.e., if the period for the scavenging operation has lapsed, steps 1919, 1921 and steps 1927 through 1939 are executed. At step 1919, the value of TAUCRNK is cleared, and at step 1921, the value of KSD is increased by multiplying it by the increasing factor KSDI. Since the value of TAUCRNK was cleared at step 1919, the routine proceeds from step 1907 to step 1923 in next execution of the routine. Therefore, the value of KSD, and accordingly the value of TAUSTA, gradually increases in every execution of the routine until the value of KSD reaches 1.0. After the value of KSD reached 1.0, the value of KSD is set at 1.0 at step 1925, and the fuel supply amount to the engine is maintained at the normal start up fuel supply amount until the value of TAUCRNK reaches KTAUCR again (step 1907).

In this embodiment, since the value of TAUCRNK is cleared when the scavenging operation is completed (steps 1909 and 1919), the fuel supply amount is also accumulated in TAUCRNK during the period in which the fuel supply amount is gradually increased. Therefore, the value of TAUCRNK exactly corresponds to the total amount of the fuel supplied to the engine, and accurate start up fuel control can be performed using this value of TAUCRNK.

I claim:

1. A start up fuel control device, for an internal combustion engine having cylinders, comprising:

start up determining means for determining whether the engine has started;

residual fuel amount calculating means for calculating a residual fuel amount parameter relating to the amount of fuel remaining in the cylinders of the engine during a start up operation of the engine;

memory means for memorizing the latest value of said residual fuel amount parameter from the beginning of the start up operation of the engine until the start up determining means determines that the engine has started, regardless of whether a main switch of the engine is turned on or turned off;

scavenging means for initiating a scavenging operation of the engine in which a fuel supply amount to the engine is reduced when the value of said residual fuel amount parameter memorized in the memory means becomes larger than a predetermined first value;

a scavenged fuel amount calculating means for calculating a scavenged fuel amount parameter relating to the amount of fuel expelled from the cylinders since the scavenging operation of the engine started; and restoring means for increasing the fuel supply amount to the engine when the value of said scavenged fuel amount parameter becomes larger than a predetermined second value until the fuel supply amount reaches a fuel supply amount before the scavenging operation started.

2. A device according to claim 1, wherein said scavenging means comprises means for changing the fuel supply amount to the engine so that the fuel supply amount increases and decreases within the range not exceeding the fuel supply amount before the scavenging operation started.

3. A device according to claim 1, wherein said restoring means comprises means for gradually increasing the fuel supply amount to the engine until the fuel supply amount reaches the fuel supply amount before the scavenging operation started.

4. A device according to claim 1, wherein said residual fuel amount calculating means comprises means for calculating a cumulative time of a cranking operation of the engine, and uses said cumulative time of the cranking operation as the residual fuel amount parameter.

5. A device according to claim 1, wherein said residual fuel amount calculating means comprises means for calculating a cumulative value of the fuel supply amount to the engine during a cranking operation of the engine, and uses said cumulative value of the fuel supply amount as the residual fuel amount parameter.

6. A device according to claim 4, wherein said scavenged fuel amount calculating means comprises means for calculating a cumulative time of the cranking operation of the engine during the scavenging operation, and uses said cumulative time of the cranking operation during the scavenging operation as the scavenged fuel amount parameter.

7. A device according to claim 5, wherein said scavenged fuel amount calculating means comprises means for calculating the cumulative time of the cranking operation of the engine during the scavenging operation, and uses said cumulative time of the cranking operation during the scavenging operation as the scavenged fuel amount parameter.

8. A device according to claim 4, wherein said scavenged fuel amount calculating means comprises means for calculating the cumulative number of revolutions of the engine from the time the scavenging operation started, and uses said cumulative number of revolutions of the engine as the scavenged fuel amount parameter.

9. A device according to claim 5, wherein said scavenged fuel amount calculating means comprises means for calculating a cumulative number of revolutions of the engine from the time the scavenging operation started, and uses said cumulative number of revolutions of the engine as the scavenged fuel amount parameter.

10. A device according to claim 4, further comprising a scavenging timing adjusting means for changing said first value for the residual fuel amount parameter according to at least one of the amount of deposits accumulated on the inlet ports of the cylinders of the engine, the revolution speed of the engine, the temperature of the coolant of the engine, the temperature of the inlet air of the engine and the fuel supply amount to the engine.

11. A device according to claim 5, further comprising a scavenging timing adjusting means for changing said first value for the residual fuel amount parameter according to at least one of the amount of deposits accumulated on the inlet ports of the cylinders of the engine, the revolution speed of the engine, the temperature of the coolant of the engine, the temperature of the inlet air of the engine and the fuel supply amount to the engine.

12. A device according to claim 4, further comprising a restoring timing adjusting means for changing said second value for the scavenged fuel amount parameter according to at least one of the amount of deposits accumulated on the inlet ports of the cylinders of the engine, the revolution speed of the engine, the temperature of the coolant of the engine, the temperature of the inlet air of the engine and the fuel supply amount to the engine.

13. A device according to claim 5, further comprising a restoring timing adjusting means for changing said second value for the scavenged fuel amount parameter according to at least one of the amount of deposits accumulated on the inlet ports of the cylinders of the engine, the revolution speed of the engine, the temperature of the coolant of the engine, the temperature of the inlet air of the engine and the fuel supply amount to the engine.

14. A device according to claim 1, wherein:

said residual fuel amount calculating means calculates said residual fuel amount parameters for the respective cylinders of the engine separately;

said memory means memorizes the latest values of said residual fuel amount of the respective cylinders regardless of whether the main switch of the engine is turned on or turned off;

said scavenging means initiates said scavenging operation by reducing the fuel supplied to a cylinder when said residual fuel amount parameter of said cylinder becomes larger than the predetermined first value;

said scavenged fuel amount calculating means calculates said scavenged fuel amount parameters for the respective cylinders separately during the scavenging operation of the respective cylinders; and said restoring means increases the fuel supply amount to a cylinder when the value of said scavenged fuel amount parameter of said cylinder becomes larger than the predetermined second value until the fuel supply amount to said cylinder reaches the fuel supply amount before the scavenging operation of said cylinder started.

15. A device according to claim 14, further comprising firing detecting means for detecting the cylinder in which firing started, wherein said restoring means increases the fuel supply amount to a cylinder until the fuel supply amount reaches the fuel supply amount before the scavenging operation of said cylinder started regardless of the value of the scavenged fuel amount parameter of said cylinder when the firing of said cylinder is detected.

* * * * *